US011851724B2

(12) United States Patent
Quanci et al.

(10) Patent No.: US 11,851,724 B2
(45) Date of Patent: Dec. 26, 2023

(54) FOUNDRY COKE PRODUCTS, AND ASSOCIATED SYSTEMS, DEVICES, AND METHODS

(71) Applicant: SUNCOKE TECHNOLOGY AND DEVELOPMENT LLC, Lisle, IL (US)

(72) Inventors: John Francis Quanci, Haddonfield, NJ (US); John Michael Richardson, Devon, PA (US); Jonathan Hale Perkins, Lisle, IL (US)

(73) Assignee: SUNCOKE TECHNOLOGY AND DEVELOPMENT LLC., Lisle, IL (US)

( * ) Notice: Subject to any disclaimer, the term of this patent is extended or adjusted under 35 U.S.C. 154(b) by 0 days.

(21) Appl. No.: 18/052,760

(22) Filed: Nov. 4, 2022

(65) Prior Publication Data

US 2023/0147916 A1 May 11, 2023

Related U.S. Application Data

(60) Provisional application No. 63/275,896, filed on Nov. 4, 2021.

(51) Int. Cl.
*C21B 5/04* (2006.01)
*C21B 5/00* (2006.01)

(52) U.S. Cl.
CPC ..... *C21B 5/007* (2013.01)

(58) Field of Classification Search
CPC ..... C21B 5/007
See application file for complete search history.

(56) References Cited

U.S. PATENT DOCUMENTS

| | | | |
|---|---|---|---|
| 425,797 | A | 4/1890 | Hunt |
| 469,868 | A | 3/1892 | Osbourn |
| 705,926 | A | 7/1902 | Hemingway |
| 760,372 | A | 5/1904 | Beam |
| 845,719 | A | 2/1907 | Schniewind |
| 875,989 | A | 1/1908 | Garner |
| 976,580 | A | 7/1909 | Krause |

(Continued)

FOREIGN PATENT DOCUMENTS

| | | |
|---|---|---|
| CA | 1172895 | 8/1984 |
| CA | 2775992 | 5/2011 |

(Continued)

OTHER PUBLICATIONS

U.S. Appl. No. 18/168,142, filed Feb. 13, 2023, Quanci et al.

(Continued)

*Primary Examiner* — Ellen M McAvoy
*Assistant Examiner* — Chantel Graham
(74) *Attorney, Agent, or Firm* — Perkins Coie LLP

(57) ABSTRACT

A coke product configured to be used in foundry cupolas to melt iron and produce cast iron products is disclosed herein. In some embodiments, the coke product has a Coke Reactivity Index (CRI) of at least 30% and an ash fusion temperature (AFT) less than 1316° C. Additionally or alternatively, the coke product can comprise (i) an ash content of at least 8.0%, (ii) a volatile matter content of no more than 1.0%, (iii) a Coke Strength After Reaction (CSR) of no more than 40%, (iv) a 2-inch drop shatter of at least 90%, and//or (v) a fixed carbon content of at least 85%.

25 Claims, 16 Drawing Sheets

(56) References Cited

U.S. PATENT DOCUMENTS 1,140,798 A 5/1915 Carpenter
1,424,777 A 8/1922 Schondeling
1,430,027 A 9/1922 Plantinga
1,486,401 A 3/1924 Van Ackeren
1,530,995 A 3/1925 Geiger
1,572,391 A 2/1926 Klaiber
1,677,973 A 7/1928 Marquard
1,705,039 A 3/1929 Thornhill
1,721,813 A 7/1929 Geipert
1,757,682 A 5/1930 Palm
1,818,370 A 8/1931 Wine
1,818,994 A 8/1931 Kreisinger
1,830,951 A 11/1931 Lovett
1,848,818 A 3/1932 Becker
1,895,202 A 1/1933 Montgomery
1,947,499 A 2/1934 Schrader et al.
1,955,962 A 4/1934 Jones
1,979,507 A 11/1934 Underwood
2,075,337 A 3/1937 Burnaugh
2,141,035 A 12/1938 Daniels
2,195,466 A 4/1940 Otto
2,235,970 A 3/1941 Wilputte
2,340,283 A 1/1944 Vladu
2,340,981 A 2/1944 Otto
2,394,173 A 2/1946 Harris et al.
2,424,012 A 7/1947 Bangham et al.
2,486,199 A 10/1949 Nier
2,609,948 A 9/1952 Laveley
2,641,575 A 6/1953 Otto
2,649,978 A 8/1953 Smith
2,667,185 A 1/1954 Beavers
2,723,725 A 11/1955 Keiffer
2,756,842 A 7/1956 Chamberlin et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
2,968,083 A 1/1961 Lentz et al.
3,015,893 A 1/1962 McCreary
3,026,715 A 3/1962 Briggs
3,033,764 A 5/1962 Hannes
3,175,961 A 3/1965 Samson
3,199,135 A 8/1965 Trucker
3,224,805 A 12/1965 Clyatt
3,259,551 A 7/1966 Thompson, Jr.
3,265,044 A 8/1966 Juchtern
3,267,913 A 8/1966 Jakob
3,327,521 A 6/1967 Briggs
3,342,990 A 9/1967 Barrington et al.
3,444,046 A 5/1969 Harlow
3,444,047 A 5/1969 Wilde
3,448,012 A 6/1969 Allred
3,453,839 A 7/1969 Sabin
3,462,345 A 8/1969 Kernan
3,511,030 A 5/1970 Brown et al.
3,542,650 A 11/1970 Kulakov
3,545,470 A 12/1970 Paton
3,587,198 A 6/1971 Hensel
3,591,827 A 7/1971 Hall
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A 5/1974 Tatterson
3,836,161 A 10/1974 Pries
3,839,156 A 10/1974 Jakobi et al.
3,844,900 A 10/1974 Schulte
3,857,758 A 12/1974 Mole
3,875,016 A 4/1975 Schmidt-Balve
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,912,597 A 10/1975 MacDonald
3,917,458 A 11/1975 Polak
3,928,144 A 12/1975 Jakimowicz
3,930,961 A 1/1976 Sustarsic et al.
3,933,443 A 1/1976 Lohrmann
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,979,870 A 9/1976 Moore
3,984,289 A 10/1976 Sustarsic et al.
3,990,948 A 11/1976 Lindgren
4,004,702 A 1/1977 Szendroi
4,004,983 A 1/1977 Pries
4,025,395 A 5/1977 Ekholm et al.
4,040,910 A 8/1977 Knappstein et al.
4,045,056 A 8/1977 Kandakov et al.
4,045,299 A 8/1977 McDonald
4,059,885 A 11/1977 Oldengott
4,065,059 A 12/1977 Jablin
4,067,462 A 1/1978 Thompson
4,077,848 A 3/1978 Grainer et al.
4,083,753 A 4/1978 Rogers et al.
4,086,231 A 4/1978 Ikio
4,093,245 A 6/1978 Connor
4,100,033 A 7/1978 Holter
4,100,491 A 7/1978 Newman, Jr. et al.
4,100,889 A 7/1978 Chayes
4,111,757 A 9/1978 Carimboli
4,124,450 A 11/1978 MacDonald
4,133,720 A 1/1979 Franzer et al.
4,135,948 A 1/1979 Mertens et al.
4,141,796 A 2/1979 Clark et al.
4,143,104 A 3/1979 van Konijnenburg et al.
4,145,195 A 3/1979 Knappstein et al.
4,147,230 A 4/1979 Ormond et al.
4,162,546 A 7/1979 Shortell et al.
4,176,013 A 11/1979 Garthus et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,226,113 A 10/1980 Pelletier et al.
4,230,498 A 10/1980 Ruecki
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,479 A 9/1981 Johnson
4,289,584 A 9/1981 Chuss et al.
4,289,585 A 9/1981 Wagener et al.
4,296,938 A 10/1981 Offermann et al.
4,298,497 A 11/1981 Colombo
4,299,666 A 11/1981 Ostmann

(56) References Cited

U.S. PATENT DOCUMENTS 4,302,935 A 12/1981 Cousimano
4,303,615 A 12/1981 Jarmell et al.
4,307,673 A 12/1981 Caughey
4,314,787 A 2/1982 Kwasnik et al.
4,316,435 A 2/1982 Nagamatsu et al.
4,324,568 A 4/1982 Wilcox et al.
4,330,372 A 5/1982 Cairns et al.
4,334,963 A 6/1982 Stog
4,336,107 A 6/1982 Irwin
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.
4,375,388 A 3/1983 Hara et al.
4,385,962 A 5/1983 Stewen et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,406,619 A 9/1983 Oldengott
4,407,237 A 10/1983 Merritt
4,421,070 A 12/1983 Sullivan
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,518,461 A 5/1985 Gelfand
4,527,488 A 7/1985 Lindgren
4,564,420 A 1/1986 Spindeler et al.
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,690,689 A 9/1987 Malcosky et al.
4,704,195 A 11/1987 Janicka et al.
4,720,262 A 1/1988 Durr et al.
4,724,976 A 2/1988 Lee
4,726,465 A 2/1988 Kwasnik et al.
4,732,652 A 3/1988 Durselen et al.
4,749,446 A 6/1988 van Laar et al.
4,793,981 A 12/1988 Doyle et al.
4,821,473 A 4/1989 Cowell
4,824,614 A 4/1989 Jones et al.
4,889,698 A 12/1989 Moller et al.
4,898,021 A 2/1990 Weaver et al.
4,918,975 A 4/1990 Voss
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,398,543 A 3/1995 Fukushima et al.
5,423,152 A 6/1995 Kolvek
5,447,606 A 9/1995 Pruitt
5,480,594 A 1/1996 Wilkerson et al.
5,542,650 A 8/1996 Abel et al.
5,597,452 A 1/1997 Hippe et al.
5,603,810 A 2/1997 Michler
5,622,280 A 4/1997 Mays et al.
5,659,110 A 8/1997 Herden et al.
5,670,025 A 9/1997 Baird
5,687,768 A 11/1997 Albrecht et al.
5,705,037 A 1/1998 Reinke et al.
5,715,962 A 2/1998 McDonnell
5,720,855 A 2/1998 Baird
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,881,551 A 3/1999 Dang
5,913,448 A 6/1999 Mann et al.
5,928,476 A 7/1999 Daniels
5,966,886 A 10/1999 Di Loreto
5,968,320 A 10/1999 Sprague
6,002,993 A 12/1999 Naito et al.
6,003,706 A 12/1999 Rosen
6,017,214 A 1/2000 Sturgulewski
6,059,932 A 5/2000 Sturgulewski
6,126,910 A 10/2000 Wilhelm et al.
6,139,692 A 10/2000 Tamura et al.
6,152,668 A 11/2000 Knoch
6,156,688 A 12/2000 Ando et al.
6,173,679 B1 1/2001 Bruckner et al.
6,187,148 B1 2/2001 Sturgulewski
6,189,819 B1 2/2001 Racine
6,290,494 B1 9/2001 Barkdoll
6,412,221 B1 7/2002 Emsbo
6,495,268 B1 12/2002 Harth, III et al.
6,539,602 B1 4/2003 Ozawa et al.
6,596,128 B2 7/2003 Westbrook
6,626,984 B1 9/2003 Taylor
6,699,035 B2 3/2004 Brooker
6,712,576 B2 3/2004 Skarzenski et al.
6,758,875 B2 7/2004 Reid et al.
6,786,941 B2 9/2004 Reeves et al.
6,830,660 B1 12/2004 Yamauchi et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,547,377 B2 6/2009 Inamasu et al.
7,611,609 B1 11/2009 Valia et al.
7,644,711 B2 1/2010 Creel
7,722,843 B1 5/2010 Srinivasachar
7,727,307 B2 6/2010 Winkler
7,785,447 B2 8/2010 Eatough et al.
7,803,627 B2 9/2010 Hodges et al.
7,823,401 B2 11/2010 Takeuchi et al.
7,827,689 B2 11/2010 Crane
7,998,316 B2 8/2011 Barkdoll
8,071,060 B2 12/2011 Ukai et al.
8,079,751 B2 12/2011 Kapila et al.
8,080,088 B1 12/2011 Srinivasachar
8,146,376 B1 4/2012 Williams et al.
8,152,970 B2 4/2012 Barkdoll et al.
8,172,930 B2 5/2012 Barkdoll
8,236,142 B2 8/2012 Westbrook
8,266,853 B2 9/2012 Bloom et al.

(56) References Cited

U.S. PATENT DOCUMENTS 8,383,055 B2 2/2013 Palmer
8,398,935 B2 3/2013 Howell et al.
8,409,405 B2 4/2013 Kim et al.
8,500,881 B2 8/2013 Orita et al.
8,515,508 B2 8/2013 Kawamura et al.
8,568,568 B2 10/2013 Schuecker et al.
8,640,635 B2 2/2014 Bloom et al.
8,647,476 B2 2/2014 Kim et al.
8,800,795 B2 8/2014 Hwang
8,956,995 B2 2/2015 Masatsugu et al.
8,980,063 B2 3/2015 Kim et al.
9,039,869 B2 5/2015 Kim et al.
9,057,023 B2 6/2015 Reichelt et al.
9,103,234 B2 8/2015 Gu et al.
9,169,439 B2 10/2015 Sarpen et al.
9,193,913 B2 11/2015 Quanci et al.
9,193,915 B2 11/2015 West et al.
9,200,225 B2 12/2015 Barkdoll et al.
9,238,778 B2 1/2016 Quanci et al.
9,243,186 B2 1/2016 Quanci et al.
9,249,357 B2 2/2016 Quanci et al.
9,273,249 B2 3/2016 Quanci et al.
9,273,250 B2 3/2016 Choi et al.
9,321,965 B2 4/2016 Barkdoll
9,359,554 B2 6/2016 Quanci et al.
9,404,043 B2 8/2016 Kim
9,463,980 B2 10/2016 Fukada et al.
9,476,547 B2 10/2016 Quanci et al.
9,498,786 B2 11/2016 Pearson
9,580,656 B2 2/2017 Quanci et al.
9,672,499 B2 6/2017 Quanci et al.
9,683,740 B2 6/2017 Rodgers et al.
9,708,542 B2 7/2017 Quanci et al.
9,862,888 B2 1/2018 Quanci et al.
9,976,089 B2 5/2018 Quanci et al.
10,016,714 B2 7/2018 Quanci et al.
10,041,002 B2 8/2018 Quanci et al.
10,047,295 B2 8/2018 Chun et al.
10,047,296 B2 8/2018 Chun et al.
10,053,627 B2 8/2018 Sarpen et al.
10,233,392 B2 3/2019 Quanci et al.
10,308,876 B2 6/2019 Quanci et al.
10,323,192 B2 6/2019 Quanci et al.
10,392,563 B2 8/2019 Kim et al.
10,435,042 B1 10/2019 Weymouth
10,526,541 B2 1/2020 West et al.
10,526,542 B2 1/2020 Quanci et al.
10,578,521 B1 3/2020 Dinakaran et al.
10,611,965 B2 4/2020 Quanci et al.
10,619,101 B2 4/2020 Quanci et al.
10,732,621 B2 8/2020 Cella et al.
10,760,002 B2 9/2020 Ball et al.
10,851,306 B2 12/2020 Crum et al.
10,877,007 B2 12/2020 Steele et al.
10,883,051 B2 1/2021 Quanci et al.
10,920,148 B2 2/2021 Quanci et al.
10,927,303 B2 2/2021 Choi et al.
10,947,455 B2 3/2021 Quanci et al.
10,968,393 B2 4/2021 West et al.
10,968,395 B2 4/2021 Quanci et al.
10,975,309 B2 4/2021 Quanci et al.
10,975,310 B2 4/2021 Quanci et al.
10,975,311 B2 4/2021 Quanci et al.
1,378,782 A1 5/2021 Floyd
11,008,517 B2 5/2021 Chun et al.
11,008,518 B2 5/2021 Quanci et al.
11,021,655 B2 6/2021 Quanci et al.
11,053,444 B2 7/2021 Quanci et al.
11,060,032 B2 7/2021 Quanci et al.
11,071,935 B2 7/2021 Quanci et al.
11,098,252 B2 8/2021 Quanci et al.
11,117,087 B2 9/2021 Quanci
11,142,699 B2 10/2021 West et al.
11,186,778 B2 11/2021 Crum et al.
11,193,069 B2 12/2021 Quanci et al.
11,214,739 B2 1/2022 Quanci et al.
11,261,381 B2 3/2022 Quanci et al.
11,359,145 B2 6/2022 Ball et al.
11,359,146 B2 6/2022 Quanci et al.
11,365,355 B2 6/2022 Quanci et al.
11,395,989 B2 7/2022 Quanci et al.
1,429,346 A1 9/2022 Horn
11,441,077 B2 9/2022 Quanci et al.
11,441,078 B2 9/2022 Quanci et al.
2002/0170605 A1 11/2002 Shiraishi et al.
2003/0014954 A1 1/2003 Ronning et al.
2003/0015809 A1 1/2003 Carson
2003/0057083 A1 3/2003 Eatough et al.
2004/0016377 A1* 1/2004 Johnson ..... C10L 10/04 110/342
2004/0220840 A1 11/2004 Bonissone et al.
2005/0087767 A1 4/2005 Fitzgerald et al.
2005/0096759 A1 5/2005 Benjamine et al.
2006/0029532 A1 2/2006 Breen et al.
2006/0102420 A1 5/2006 Huber et al.
2006/0149407 A1 7/2006 Markham et al.
2007/0087946 A1 4/2007 Quest et al.
2007/0102278 A1 5/2007 Inamasu et al.
2007/0116619 A1 5/2007 Taylor et al.
2007/0251198 A1 11/2007 Witter
2008/0028935 A1 2/2008 Andersson
2008/0179165 A1 7/2008 Chen et al.
2008/0250863 A1 10/2008 Moore
2008/0257236 A1 10/2008 Green
2008/0271985 A1 11/2008 Yamasaki
2008/0289305 A1 11/2008 Girondi
2009/0007785 A1 1/2009 Kimura et al.
2009/0032385 A1 2/2009 Engle
2009/0105852 A1 4/2009 Wintrich et al.
2009/0152092 A1 6/2009 Kim et al.
2009/0162269 A1 6/2009 Barger et al.
2009/0217576 A1 9/2009 Kim et al.
2009/0257932 A1 10/2009 Canari et al.
2009/0283395 A1 11/2009 Hippe
2010/0015564 A1 1/2010 Chun et al.
2010/0095521 A1 4/2010 Kartal et al.
2010/0106310 A1 4/2010 Grohman
2010/0113266 A1 5/2010 Abe et al.
2010/0115912 A1 5/2010 Worley
2010/0119425 A1 5/2010 Palmer
2010/0181297 A1 7/2010 Whysail
2010/0196597 A1 8/2010 Di Loreto
2010/0276269 A1 11/2010 Schuecker et al.
2010/0287871 A1 11/2010 Bloom et al.
2010/0300867 A1 12/2010 Kim et al.
2010/0314234 A1 12/2010 Knoch et al.
2011/0000284 A1 1/2011 Kumar et al.
2011/0014406 A1 1/2011 Coleman et al.
2011/0048917 A1 3/2011 Kim et al.
2011/0083314 A1 4/2011 Baird
2011/0088600 A1 4/2011 McRae
2011/0120852 A1 5/2011 Kim
2011/0144406 A1 6/2011 Masatsugu et al.
2011/0168482 A1 7/2011 Merchant et al.
2011/0174301 A1 7/2011 Haydock et al.
2011/0192395 A1 8/2011 Kim
2011/0198206 A1 8/2011 Kim et al.
2011/0223088 A1 9/2011 Chang et al.
2011/0253521 A1 10/2011 Kim
2011/0291827 A1 12/2011 Baldocchi et al.
2011/0313218 A1 12/2011 Dana
2011/0315538 A1 12/2011 Kim et al.
2012/0031076 A1 2/2012 Frank et al.
2012/0125709 A1 5/2012 Merchant et al.
2012/0152720 A1 6/2012 Reichelt et al.
2012/0177541 A1 7/2012 Mutsuda et al.
2012/0179421 A1 7/2012 Dasgupta
2012/0180133 A1 7/2012 Ai-Harbi et al.
2012/0228115 A1 9/2012 Westbrook
2012/0247939 A1 10/2012 Kim et al.
2012/0305380 A1 12/2012 Wang et al.
2012/0312019 A1 12/2012 Rechtman
2013/0020781 A1 1/2013 Kishikawa
2013/0045149 A1 2/2013 Miller

(56) References Cited

U.S. PATENT DOCUMENTS

| | | | |
|---|---|---|---|
| 2013/0213114 | A1 | 8/2013 | Wetzig et al. |
| 2013/0216717 | A1 | 8/2013 | Rago et al. |
| 2013/0220373 | A1 | 8/2013 | Kim |
| 2013/0306462 | A1 | 11/2013 | Kim et al. |
| 2014/0039833 | A1 | 2/2014 | Sharpe, Jr. et al. |
| 2014/0156584 | A1 | 6/2014 | Motukuri et al. |
| 2014/0208997 | A1 | 7/2014 | Alferyev et al. |
| 2014/0224123 | A1 | 8/2014 | Walters |
| 2015/0041304 | A1 | 2/2015 | Kiim et al. |
| 2015/0122629 | A1 | 5/2015 | Freimuth et al. |
| 2015/0143908 | A1 | 5/2015 | Cetinkaya |
| 2015/0175433 | A1 | 6/2015 | Micka et al. |
| 2015/0219530 | A1 | 8/2015 | Li et al. |
| 2015/0226499 | A1 | 8/2015 | Mikkelsen |
| 2016/0026193 | A1 | 1/2016 | Rhodes et al. |
| 2016/0048139 | A1 | 2/2016 | Samples et al. |
| 2016/0149944 | A1 | 5/2016 | Obermeirer et al. |
| 2016/0154171 | A1 | 6/2016 | Kato et al. |
| 2016/0370082 | A1 | 12/2016 | Olivo |
| 2017/0173519 | A1 | 6/2017 | Naito |
| 2017/0182447 | A1 | 6/2017 | Sappok et al. |
| 2017/0226425 | A1 | 8/2017 | Kim et al. |
| 2017/0261417 | A1 | 9/2017 | Zhang |
| 2017/0313943 | A1 | 11/2017 | Valdevies |
| 2017/0352243 | A1 | 12/2017 | Quanci et al. |
| 2019/0317167 | A1 | 10/2019 | LaBorde et al. |
| 2020/0071190 | A1 | 3/2020 | Wiederin et al. |
| 2020/0139273 | A1 | 5/2020 | Badiei |
| 2020/0173679 | A1 | 6/2020 | O'Reilly et al. |
| 2020/0208059 | A1 | 7/2020 | Quanci et al. |
| 2020/0208063 | A1 | 7/2020 | Quanci et al. |
| 2020/0208833 | A1 | 7/2020 | Quanci et al. |
| 2021/0130697 | A1 | 5/2021 | Quanci et al. |
| 2021/0163821 | A1 | 6/2021 | Quanci et al. |
| 2021/0163823 | A1 | 6/2021 | Quanci et al. |
| 2021/0198579 | A1 | 7/2021 | Quanci et al. |
| 2021/0261877 | A1 | 8/2021 | Despen et al. |
| 2021/0340454 | A1* | 11/2021 | Quanci ..... C10L 5/04 |
| 2021/0363426 | A1 | 11/2021 | West et al. |
| 2021/0363427 | A1 | 11/2021 | Quanci et al. |
| 2021/0371752 | A1 | 12/2021 | Quanci et al. |
| 2021/0388270 | A1 | 12/2021 | Choi et al. |
| 2022/0056342 | A1 | 2/2022 | Quanci et al. |
| 2022/0106527 | A1 | 4/2022 | Quanci et al. |
| 2022/0195303 | A1 | 6/2022 | Quanci et al. |
| 2022/0204858 | A1 | 6/2022 | West et al. |
| 2022/0204859 | A1 | 6/2022 | Crum et al. |
| 2022/0226766 | A1 | 7/2022 | Quanci et al. |
| 2022/0251452 | A1 | 8/2022 | Quanci et al. |
| 2022/0298423 | A1 | 9/2022 | Quanci et al. |
| 2022/0325183 | A1 | 10/2022 | Quanci et al. |
| 2022/0356410 | A1 | 11/2022 | Quanci et al. |

FOREIGN PATENT DOCUMENTS

| | | | |
|---|---|---|---|
| CA | 2822841 | | 7/2012 |
| CA | 2822857 | | 7/2012 |
| CA | 2905110 | A1 | 9/2014 |
| CN | 87212113 | U | 6/1988 |
| CN | 87107195 | A | 7/1988 |
| CN | 2064363 | U | 10/1990 |
| CN | 2139121 | Y | 7/1993 |
| CN | 1092457 | A | 9/1994 |
| CN | 1255528 | A | 6/2000 |
| CN | 1270983 | A | 10/2000 |
| CN | 2528771 | Y | 2/2002 |
| CN | 1358822 | A | 7/2002 |
| CN | 2521473 | Y | 11/2002 |
| CN | 1468364 | A | 1/2004 |
| CN | 1527872 | A | 9/2004 |
| CN | 2668641 | | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 101211495 | A | 7/2008 |
| CN | 201121178 | Y | 9/2008 |
| CN | 101395248 | A | 3/2009 |
| CN | 100510004 | C | 7/2009 |
| CN | 101486017 | A | 7/2009 |
| CN | 201264981 | Y | 7/2009 |
| CN | 101497835 | A | 8/2009 |
| CN | 101509427 | A | 8/2009 |
| CN | 101886466 | A | 11/2010 |
| CN | 101910530 | A | 12/2010 |
| CN | 102072829 | A | 5/2011 |
| CN | 102155300 | A | 8/2011 |
| CN | 2509188 | Y | 11/2011 |
| CN | 202226816 | | 5/2012 |
| CN | 202265541 | U | 6/2012 |
| CN | 102584294 | A | 7/2012 |
| CN | 202415446 | U | 9/2012 |
| CN | 202470353 | U | 10/2012 |
| CN | 103399536 | A | 11/2013 |
| CN | 103468289 | A | 12/2013 |
| CN | 103913193 | A | 7/2014 |
| CN | 203981700 | U | 12/2014 |
| CN | 104498059 | A | 4/2015 |
| CN | 105001914 | A | 10/2015 |
| CN | 105137947 | A | 12/2015 |
| CN | 105189704 | A | 12/2015 |
| CN | 105264448 | A | 1/2016 |
| CN | 105467949 | A | 4/2016 |
| CN | 106661456 | A | 5/2017 |
| CN | 106687564 | A | 5/2017 |
| CN | 107445633 | A | 12/2017 |
| CN | 100500619 | C | 6/2020 |
| DE | 201729 | C | 9/1908 |
| DE | 212176 | | 7/1909 |
| DE | 1212037 | B | 3/1966 |
| DE | 2212544 | A | 1/1973 |
| DE | 2720688 | A1 | 11/1978 |
| DE | 3231697 | C1 | 1/1984 |
| DE | 3328702 | A1 | 2/1984 |
| DE | 3315738 | C2 | 3/1984 |
| DE | 3329367 | C | 11/1984 |
| DE | 3407487 | C1 | 6/1985 |
| DE | 19545736 | | 6/1997 |
| DE | 19803455 | | 8/1999 |
| DE | 10122531 | A1 | 11/2002 |
| DE | 10154785 | | 5/2003 |
| DE | 102005015301 | | 10/2006 |
| DE | 102006004669 | | 8/2007 |
| DE | 102006026521 | | 12/2007 |
| DE | 102009031436 | | 1/2011 |
| DE | 102011052785 | | 12/2012 |
| EA | 010510 | B1 | 10/2008 |
| EP | 0126399 | A1 | 11/1984 |
| EP | 0208490 | A1 | 1/1987 |
| EP | 0903393 | A2 | 3/1999 |
| EP | 1538503 | A1 | 6/2005 |
| EP | 1860034 | A1 | 11/2007 |
| EP | 2295129 | A1 | 3/2011 |
| EP | 2468837 | A1 | 6/2012 |
| FR | 2339664 | | 8/1977 |
| FR | 2517802 | | 6/1983 |
| FR | 2764978 | | 12/1998 |
| GB | 364236 | A | 1/1932 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 871094 | | 6/1961 |
| GB | 923205 | A | 5/1963 |
| JP | S50148405 | | 11/1975 |
| JP | S5319301 | A | 2/1978 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | S57172978 | A | 10/1982 |

(56) References Cited

FOREIGN PATENT DOCUMENTS

| | | | |
|---|---|---|---|
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | H05230466 | A | 9/1993 |
| JP | H0649450 | A | 2/1994 |
| JP | H0654753 | U | 7/1994 |
| JP | H06264062 | | 9/1994 |
| JP | H06299156 | A | 10/1994 |
| JP | 07188668 | | 7/1995 |
| JP | 07216357 | | 8/1995 |
| JP | H07204432 | | 8/1995 |
| JP | H08104875 | A | 4/1996 |
| JP | 08127778 | | 5/1996 |
| JP | H10273672 | A | 10/1998 |
| JP | H11131074 | | 5/1999 |
| JP | H11256166 | A | 9/1999 |
| JP | 2000204373 | A | 7/2000 |
| JP | 2000219883 | A | 8/2000 |
| JP | 2001055576 | A | 2/2001 |
| JP | 2001200258 | | 7/2001 |
| JP | 2002097472 | A | 4/2002 |
| JP | 2002106941 | | 4/2002 |
| JP | 2003041258 | | 2/2003 |
| JP | 2003051082 | A | 2/2003 |
| JP | 2003071313 | A | 3/2003 |
| JP | 2003292968 | A | 10/2003 |
| JP | 2003342581 | A | 12/2003 |
| JP | 2004169016 | A | 6/2004 |
| JP | 2005503448 | A | 2/2005 |
| JP | 2005135422 | A | 5/2005 |
| JP | 2005154597 | A | 6/2005 |
| JP | 2005263983 | A | 9/2005 |
| JP | 2005344085 | A | 12/2005 |
| JP | 2006188608 | A | 7/2006 |
| JP | 2007063420 | A | 3/2007 |
| JP | 2007231326 | A | 9/2007 |
| JP | 4101226 | B2 | 6/2008 |
| JP | 2008231278 | A | 10/2008 |
| JP | 2009019106 | A | 1/2009 |
| JP | 2009073864 | A | 4/2009 |
| JP | 2009073865 | A | 4/2009 |
| JP | 2009135276 | A | 6/2009 |
| JP | 2009144121 | | 7/2009 |
| JP | 2010229239 | A | 10/2010 |
| JP | 2010248389 | A | 11/2010 |
| JP | 2011504947 | A | 2/2011 |
| JP | 2011068733 | A | 4/2011 |
| JP | 2011102351 | A | 5/2011 |
| JP | 2012102302 | | 5/2012 |
| JP | 2012102325 | A | 5/2012 |
| JP | 2013006957 | A | 1/2013 |
| JP | 2013510910 | | 3/2013 |
| JP | 2013189322 | A | 9/2013 |
| JP | 2014040502 | A | 3/2014 |
| JP | 2015094091 | A | 5/2015 |
| JP | 2016169897 | A | 9/2016 |
| KR | 1019960008754 | | 10/1996 |
| KR | 19990017156 | U | 5/1999 |
| KR | 1019990054426 | | 7/1999 |
| KR | 20000042375 | A | 7/2000 |
| KR | 100296700 | B1 | 10/2001 |
| KR | 20030012458 | A | 2/2003 |
| KR | 1020040020883 | A | 3/2004 |
| KR | 20040107204 | A | 12/2004 |
| KR | 20050053861 | A | 6/2005 |
| KR | 20060132336 | A | 12/2006 |
| KR | 100737393 | B1 | 7/2007 |
| KR | 100797852 | | 1/2008 |
| KR | 20080069170 | A | 7/2008 |
| KR | 20110010452 | A | 2/2011 |
| KR | 101314288 | | 4/2011 |
| KR | 20120033091 | A | 4/2012 |
| KR | 20130050807 | | 5/2013 |
| KR | 101318388 | | 10/2013 |
| KR | 20140042526 | A | 4/2014 |
| KR | 20150011084 | A | 1/2015 |
| KR | 20170038102 | A | 4/2017 |
| KR | 20170058808 | A | 5/2017 |
| KR | 20170103857 | A | 9/2017 |
| KR | 101862491 | B1 | 5/2018 |
| RU | 2083532 | C1 | 7/1997 |
| RU | 2441898 | C2 | 2/2012 |
| RU | 2493233 | C2 | 9/2013 |
| SU | 1535880 | A1 | 1/1990 |
| TW | 201241166 | A1 | 10/2012 |
| TW | 201245431 | A1 | 11/2012 |
| UA | 50580 | | 10/2002 |
| WO | WO9012074 | | 10/1990 |
| WO | WO9945083 | | 9/1999 |
| WO | WO02062922 | | 8/2002 |
| WO | WO2005023649 | | 3/2005 |
| WO | WO2005031297 | | 4/2005 |
| WO | WO2005115583 | | 12/2005 |
| WO | WO2007103649 | | 9/2007 |
| WO | WO2008034424 | | 3/2008 |
| WO | WO2008105269 | | 9/2008 |
| WO | WO2011000447 | | 1/2011 |
| WO | WO2011126043 | | 10/2011 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2014021909 | | 2/2014 |
| WO | WO2014043667 | | 3/2014 |
| WO | WO2014105064 | | 7/2014 |
| WO | WO2014153050 | | 9/2014 |
| WO | WO2016004106 | | 1/2016 |
| WO | WO2016033511 | | 3/2016 |
| WO | WO2016086322 | | 6/2016 |

OTHER PUBLICATIONS

Lin, Rongying et al., "Study on the synergistic effect of calcium and aluminum on improving ash fusion temperature of semi-coke," International Journal of Coal Preparation and Utilization, May 31, 2019 (published online), vol. 42, No. 3, pp. 556-564.

Tiwari, et al., "A novel technique for assessing the coking potential of coals/cole blends for non-recovery coke making process," Fuel, vol. 107, May 2013, pp. 615-622.

International Search Report and Written Opinion for PCT/US2022/079299; dated Mar. 17, 2023; 10 pages.

U.S. Appl. No. 07/587,742, filed Sep. 25, 1990, now U.S. Pat. No. 5,114,542, titled Nonrecovery Coke Oven Battery and Method of Operation.

U.S. Appl. No. 07/878,904, filed May 6, 1992, now U.S. Pat. No. 5,318,671, titled Method of Operation on Nonrecovery Coke Oven Battery.

U.S. Appl. No. 09/783,195, filed Feb. 14, 2001, now U.S. Pat. No. 6,596,128, titled Coke Oven Flue Gas Sharing.

U.S. Appl. No. 07/886,804, filed May 22, 1992, now U.S. Pat. No. 5,228,955, titled High Strength Coke Oven Wall Having Gas Flues Therein.

U.S. Appl. No. 08/059,673, filed May 12, 1993, now U.S. Pat. No. 5,447,606, titled Method of and Apparatus for Capturing Coke Oven Charging Emissions.

U.S. Appl. No. 08/914,140, filed Aug. 19, 1997, now U.S. Pat. No. 5,928,476, titled Nonrecovery Coke Oven Door.

(56) References Cited

OTHER PUBLICATIONS

U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus for Producing Coke.
U.S. Appl. No. 12/403,391, filed Mar. 13, 2009, now U.S. Pat. No. 8,172,930, titled Cleanable In Situ Spark Arrestor.
U.S. Appl. No. 12/849,192, filed Aug. 3, 2010, now U.S. Pat. No. 9,200,225, titled Method and Apparatus for Compacting Coal for a Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/655,204, now U.S. Pat. No. 10,016,714, filed Jun. 24, 2015, titled Systems and Methods for Removing Mercury From Emissions.
U.S. Appl. No. 16/000,516, now U.S. Pat. No. 11,117,087, filed Jun. 5, 2018, titled Systems and Methods for Removing Mercury From Emissions.
U.S. Appl. No. 17/459,380, filed Jun. 5, 2018, titled Systems and Methods for Removing Mercury From Emissions.
U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295.
U.S. Appl. No. 16/026,363, filed Jul. 3, 2018, now U.S. Pat. No. 11,008,517, titled Non-Perpendicular Connections Between Coke Oven Uptakes and a Hot Common Tunnel, and Associated Systems and Methods.
U.S. Appl. No. 13/730,796, filed Dec. 28, 2012, now U.S. Pat. No. 10,883,051, titled Methods and Systems for Improved Coke Quenching.
U.S. Appl. No. 17/140,564, filed Jan. 4, 2021, titled Methods and Systems for Improved Coke Quenching.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, now U.S. Pat. No. 11,142,699, titled Vent Stack Lids and Associated Systems and Methods.
U.S. Appl. No. 17/471,491, filed Sep. 10, 2021, now U.S. Pat. No. 11,142,699, titled Vent Stack Lids and Associated Systems and Methods.
U.S. Appl. No. 13/843,166, filed Mar. 15, 2013, now U.S. Pat. No. 9,273,250, titled Methods and Systems for Improved Quench Tower Design.
U.S. Appl. No. 15/014,547, filed Feb. 3, 2016, now, U.S. Pat. No. 10,927,303, titled Methods for Improved Quench Tower Design.
U.S. Appl. No. 17/155,818, filed Jan. 22, 2021, titled Methods and Systems for Improved Quench Tower Design.
U.S. Appl. No. 14/655,003, filed Jun. 23, 2015, now U.S. Pat. No. 10,760,002, titled Systems and Methods for Maintaining a Hot Car in a Coke Plant.
U.S. Appl. No. 16/897,957, filed Jun. 10, 2020, now U.S. Pat. No. 11,359,145, titled Systems and Methods for Maintaining a Hot Car in a Coke Plant.
U.S. Appl. No. 13/829,588, filed Mar. 14, 2013, now U.S. Pat. No. 9,193,915, titled Horizontal Heat Recovery Coke Ovens Having Monolith Crowns.
U.S. Appl. No. 15/322,176, filed Dec. 27, 2016, now U.S. Pat. No. 10,526,541, titled Horizontal Heat Recovery Coke Ovens Having Monolith Crowns.
U.S. Appl. No. 15/511,036, filed Mar. 14, 2017, now U.S. Pat. No. 10,968,383, titled Coke Ovens Having Monolith Component Construction.
U.S. Appl. No. 17/190,720, filed Mar. 3, 2021, titled Coke Ovens Having Monolith Component Construction.
U.S. Appl. No. 13/589,009, filed Aug. 17, 2012, now U.S. Pat. No. 9,359,554, titled Automatic Draft Control System for Coke Plants.
U.S. Appl. No. 15/139,568, filed Apr. 27, 2016, now U.S. Pat. No. 10,947,455, titled Automatic Draft Control System for Coke Plants.
U.S. Appl. No. 17/176,391, filed Feb. 16, 2021, titled Automatic Draft Control System for Coke Plants.
U.S. Appl. No. 13/588,996, filed Aug. 17, 2012, now U.S. Pat. No. 9,243,186, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing.
U.S. Appl. No. 16/047,198, filed Jul. 27, 2018, now U.S. Pat. No. 10,611,965, titled Coke Plant Including Exhaust Gas Sharing.
U.S. Appl. No. 16/828,448, filed Mar. 24, 2020, now U.S. Pat. No. 11,441,077, titled Coke Plant Including Exhaust Gas Sharing.
U.S. Appl. No. 13/589,004, filed Aug. 17, 2012, now U.S. Pat. No. 9,249,357, titled Method and Apparatus for Volatile Matter Sharing in Stamp-Charged Coke Ovens.
U.S. Appl. No. 13/730,673, filed Dec. 28, 2012, now U.S. Pat. No. 9,476,547, titled Exhaust Flow Modifier, Duct Intersection Incorporating the Same, and Methods Therefor.
U.S. Appl. No. 15/281,891, filed Sep. 30, 2016, now U.S. Pat. No. 10,975,309, titled Exhaust Flow Modifier, Duck Intersection Incorporating the Same, and Methods Therefor.
U.S. Appl. No. 17/191,119, filed Mar. 3, 2021, titled Exhaust Flow Modifier, Duck Intersection Incorporating the Same, and Methods Therefor.
U.S. Appl. No. 13/598,394, filed Aug. 29, 2012, now U.S. Pat. No. 9,169,439, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627.
U.S. Appl. No. 14/839,384, filed Aug. 28, 2015, now U.S. Pat. No. 9,580,656, titled Coke Oven Charging System.
U.S. Appl. No. 15/443,246, filed Feb. 27, 2017, now U.S. Pat. No. 9,976,089, titled Coke Oven Charging System.
U.S. Appl. No. 14/587,670, filed Dec. 31, 2014, now U.S. Pat. No. 10,619,101, titled Methods for Decarbonizing Coking Ovens, and Associated Systems and Devices.
U.S. Appl. No. 16/845,530, filed Apr. 10, 2020, now U.S. Pat. No. 11,359,146, titled Methods for Decarbonizing Coking Ovens, and Associated Systems and Devices.
U.S. Appl. No. 14/984,489, filed Dec. 30, 2015, now U.S. Pat. No. 10,975,310, titled Multi-Modal Beds of Coking Material.
U.S. Appl. No. 14/983,837, filed Dec. 30, 2015, now U.S. Pat. No. 10,968,395, titled Multi-Modal Beds of Coking Material.
U.S. Appl. No. 14/986,281, filed Dec. 31, 2015, now U.S. Pat. No. 10,975,311, titled Multi-Modal Beds of Coking Material.
U.S. Appl. No. 17/222,886, filed Apr. 12, 2021, titled Multi-Modal Beds of Coking Material.

(56) References Cited

OTHER PUBLICATIONS

U.S. Appl. No. 14/987,625, filed Jan. 4, 2016, now U.S. Pat. No. 11,060,032, titled Integrated Coke Plant Automation and Optimization Using Advanced Control and Optimization Techniques.
U.S. Appl. No. 17/172,476, filed Feb. 10, 2021, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, now U.S. Pat. No. 11,053,444, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, now U.S. Pat. No. 10,920,148, titled Improved Burn Profiles for Coke Operations.
U.S. Appl. No. 17/155,719, filed Jan. 22, 2021, now U.S. Pat. No. 11,441,078, titled Improved Burn Profiles for Coke Operations.
U.S. Pat. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, filed Jan. 6, 2020, now U.S. Pat. No. 11,214,739, titled Method and System for Dynamically Charging a Coke Oven.
U.S. Appl. No. 15/614,525, filed Jun. 5, 2017, now U.S. Pat. No. 11,508,230, titled Methods and Systems for Automatically Generating a Remedial Action in an Industrial Facility.
U.S. Appl. No. 18/047,916, filed Oct. 19, 2022, titled Methods and Systems for Automatically Generating a Remedial Action in an Industrial Facility.
U.S. Appl. No. 15/987,860, filed May 23, 2018, now U.S. Pat. No. 10,851,306, titled System and Method for Repairing a Coke Oven.
U.S. Appl. No. 17/076,563, filed Oct. 21, 2020, now U.S. Pat. No. 11,186,778, titled System and Method for Repairing a Coke Oven.
U.S. Appl. No. 17/521,061, filed Nov. 8, 2021, titled Systems and Method for Repairing a Coke Oven.
U.S. Appl. No. 17/135,483, filed Dec. 28, 2020, titled Oven Health Optimization Systems and Methods.
U.S. Appl. No. 16/729,053, filed Dec. 27, 2019, titled Oven Uptakes.
U.S. Appl. No. 16/729,036, filed Dec. 27, 2019, now U.S. Pat. No. 11,365,355, titled Systems and Methods for Treating A Surface of a Coke Plant.
U.S. Appl. No. 17/747,708, filed May 18, 2022, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, now U.S. Pat. No. 11,395,989, titled Methods and Systems for Providing Corrosion Resistant Surfaces in Contaminant Treatment Systems.
U.S. Appl. No. 17/843,164, filed Jun. 17, 2022, titled Methods and Systems for Providing Corrosion Resistant Surfaces in Contaminant Treatment Systems.
U.S. Appl. No. 16/729,068, filed Dec. 27, 2019, now U.S. Pat. No. 11,486,872, titled Systems and Methods for Utilizing Flue Gas.
U.S. Appl. No. 17/947,520, filed Sep. 19, 2022, titled Systems and Methods for Utilizing Flue Gas.
U.S. Appl. No. 16/729,129, filed Dec. 27, 2019, now U.S. Pat. No. 11,008,518, titled Coke Plant Tunnel Repair and Flexible Joints.
U.S. Appl. No. 17/320,343, filed May 14, 2021, now U.S. Pat. No. 11,597,881, titled Coke Plant Tunnel Repair and Flexible Joints.
U.S. Appl. No. 18/168,142, filed Feb. 13, 2023, titled Coke Plant Tunnel Repair and Flexible Joints.
U.S. Appl. No. 16/729,170, now U.S. Pat. No. 11,193,069, filed Dec. 27, 2019, titled Coke Plant Tunnel Repair and Anchor Distribution.
U.S. Appl. No. 17/532,058, now U.S. Pat. No. 11,505,747, filed Nov. 22, 2021, titled Coke Plant Tunnel Repair and Anchor Distribution.
U.S. Appl. No. 17/967,615, filed Oct. 17, 2022, titled Coke Plant Tunnel Repair and Anchor Distribution.
U.S. Appl. No. 16/729,157, filed Dec. 27, 2019, now U.S. Pat. No. 11,071,935, titled Particulate Detection for Industrial Facilities, and Associated Systems and Methods.
U.S. Appl. No. 16/729,057, filed Dec. 27, 2019, now U.S. Pat. No. 11,021,655, titled Decarbonization of Coke Ovens and Associated Systems and Methods.
U.S. Appl. No. 17/321,857, filed May 17, 2021, titled Decarbonization of Coke Ovens and Associated Systems and Methods.
U.S. Appl. No. 16/729,212, filed Dec. 27, 2019, now U.S. Pat. No. 11,261,381, titled Heat Recovery Oven Foundation.
U.S. Appl. No. 17/584,672, filed Jan. 26, 2022, titled Heat Recovery Oven Foundation.
U.S. Appl. No. 16/729,219, now U.S. Pat. No. 11,098,252, filed Dec. 27, 2019, titled Spring-Loaded Heat Recovery Oven System and Method.
U.S. Appl. No. 17/388,874, filed Jul. 29, 2021, titled Spring-Loaded Heat Recovery Oven System and Method.
U.S. Appl. No. 17/736,960, filed May 20, 2022, titled Foundry Coke Products, and Associated Systems and Methods.
U.S. Appl. No. 17/306,895, filed May 3, 2021, titled High-Quality Coke Products.
U.S. Appl. No. 18/052,739, filed Nov. 4, 2022, titled Foundry Coke Products and Associated Processing Methods Via Cupolas.
U.S. Appl. No. 17/843,164, filed Jun. 17, 2022, Quanci et al.
U.S. Appl. No. 17/947,520, filed Sep. 19, 2022, Quanci et al.
U.S. Appl. No. 17/967,615, filed Oct. 17, 2022, Quanci et al.
U.S. Appl. No. 18/047,916, filed Oct. 19, 2022, Quanci et al.
U.S. Appl. No. 18/052,739, filed Nov. 4, 2022, Quanci et al.
ASTM D5341-99(2010)e1, Standard Test Method for Measuring Coke Reactivity Index (CRI) and Coke Strength After Reaction (CSR), ASTM International, West Conshohocken, PA, 2010.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf ; 404 pages.
Basset et al., "Calculation of steady flow pressure loss coefficients for pipe junctions," Proc Instn Mech Engrs., vol. 215, Part C, p. 861-881 IMechIE 2001.
Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.
Bloom, et al., "Modular cast block—The future of coke oven repairs," Iron & Steel Technol, AIST, Warrendale, PA, vol. 4, No. 3, Mar. 1, 2007, pp. 61-64.
Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.
Clean coke process: process development studies by USS Engineers and Consultants, Inc., Wisconsin Tech Search, request date Oct. 5, 2011, 17 pages.
"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Costa, et al., "Edge Effects on the Flow Characteristics in a 90 deg Tee Junction," Transactions of the ASME, Nov. 2006, vol. 128, pp. 1204-1217.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.

(56) References Cited

OTHER PUBLICATIONS

"High Alumina Cement-Manufacture, Characteristics and Uses," TheConstructor.org, https://theconstructor.org/concrete/high-alumina-cement/23686/; 12 pages.
Industrial Furnace Design Handbook, Editor-in-Chief: First Design Institute of First Ministry of Machinery Industry, Beijing: Mechanical Industry Press, pp. 180-183, Oct. 1981.
Joseph, B., "A tutorial on inferential control and its applications," Proceedings of the 1999 American Control Conference (Cat. No. 99CH36251), San Diego, CA, 1999, pp. 3106-3118 vol. 5.
Kerlin, Thomas (1999), Practical Thermocouple Thermometry—1.1 The Thermocouple. ISA. Online version available at https:app.knovel.com/pdf/id:kt007XPTM3/practical-thermocouple/the-thermocouple.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Madias, et al., "A review on stamped charging of coals" (2013). Available at https://www.researchgate.net/publication/263887759_A_review_on_stamped_charging_of_coals.
Metallurgical Coke MSDS, ArcelorMittal, May 30, 2011, available online at http://dofasco.arcelormittal.com/-/media/Files/A/Arcelormittal-Canada/material-safety/metallurgical-coke.pdf.
"Middletown Coke Company HRSG Maintenance BACT Analysis Option 1—Individual Spray Quenches Sun Heat Recovery Coke Facility Process Flow Diagram Middletown Coke Company 100 Oven Case #1-24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7 * * pp. 8-11 *.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
"Refractory Castables," Victas.com, Dec. 28, 2011 (date obtained from WayBack Machine), https://www/vitcas.com/refactory-castables; 5 pages.
Rose, Harold J., "The Selection of Coals for the Manufacture of Coke," American Institute of Mining and Metallurgical Engineers, Feb. 1926, 8 pages.
Waddell, et al., "Heat-Recovery Cokemaking Presentation," Jan. 1999, pp. 1-25.
Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.
Westbrook, "Heat-Recovery Cokemaking at Sun Coke," AISE Steel Technology, Pittsburg, PA, vol. 76, No. 1, Jan. 1999, pp. 25-28.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-control.4728/; 8 pages.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.

* cited by examiner

450

| | Batch 1 | Batch 2 | Batch 3 | Batch 4 | Batch 4 (production |
|---|---|---|---|---|---|
| Total Ash (wt %) | 9.54 | 8.79 | 8.45 | 8.13 | 8.04 |
| Ash Fusion IDT (°F) | N/A | 2420 | 2370 | 2233 | 2150 |
| Ash Fusion ST (°F) | N/A | 2500 | 2510 | 2377 | 2370 |
| $A1_2O_3$ in Coal Blend Ash Composition (wt %) | 28.5 | 26.3 | 26.1 | 24.9 | 24.1 |
| $SiO_2$ in Coal Blend Ash Composition (wt %) | 49.4 | 48.9 | 48.8 | 49.1 | 46.0 |
| Ash Fusion (calculated by Formula (IA) or (IB)) | 2604 | 2544 | 2517 | 2494 | 2408 |
| CRI (wt %) | 30 | 36 | 32 | 36.5 | 35.5 |
| CSR (wt %) | 41 | 16 | 26 | 15.3 | 15.6 |

FOUNDRY COKE PRODUCTS, AND ASSOCIATED SYSTEMS, DEVICES, AND METHODS

CROSS-REFERENCE TO RELATED APPLICATIONS

This application claims priority to U.S. Provisional Patent Application No. 63/275,896, filed Nov. 4, 2021, the disclosure of which is incorporated herein by reference in its entirety.

TECHNICAL FIELD

This disclosure relates to foundry coke products, and associated systems, devices, and methods.

BACKGROUND

Coke can be divided into various subcategories. Foundry coke has a large size relative to blast coke and is of exceptional quality, including relatively low impurities, and relatively high carbon content, strength, and stability. Foundry coke is used in foundry cupolas to melt iron and produce cast iron and ductile iron products. However, the production cost, including the manufacturing cost, transportation cost, and environmental cost, for foundry coke is high. Therefore, there is a need in the art to improve the production process thereby to obtain high quality foundry coke at a higher yield or a lower cost.

Coke is a solid carbon fuel and carbon source produced from coal that is used in the production of steel. The coal can be obtained from a combination of different coal sources and often possess vastly different qualities and compositions. These resources can be used as fuel or feedstock for a diverse array of applications, such as steel production, cement production, and electricity generation. Furthermore, the diverse array of regulatory environments or economic incentives can further create additional requirements for the types of coal that a specific foundry, factory, or plant is permitted to use.

BRIEF DESCRIPTION OF THE DRAWINGS

Features, aspects, and advantages of the presently disclosed technology can be better understood with regard to the following drawings.

Figure 1:
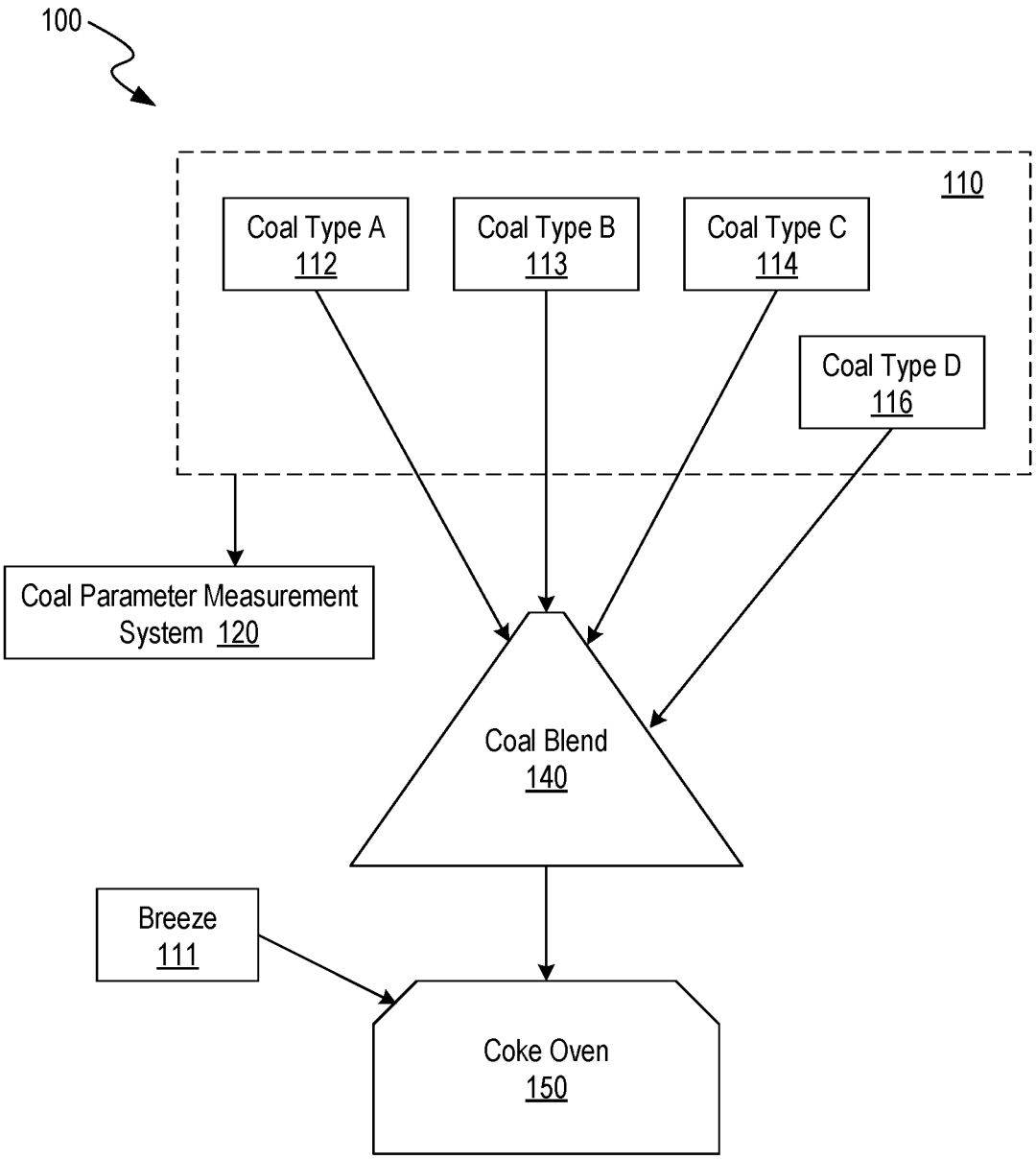
FIG. 1 shows an illustrative schematic system for obtaining coal parameters for multiple coal types and determining a coal blend formulation, in accordance with one or more embodiments of the present technology.

A person skilled in the relevant art will understand that the features shown in the drawings are for purposes of illustrations, and variations, including different or additional features and arrangements thereof, are possible.

DETAILED DESCRIPTION

I. Overview

Foundry coke is coke of a relatively large size, and of exceptional quality, such as very low content of impurities, and very high fixed carbon content, strength, and stability. Foundry coke is used in cupola furnaces to melt iron and recycled steel and as a carbon source to produce cast iron and ductile iron products. However, the production cost, including the manufacturing cost, transportation cost, and environmental cost, for foundry coke is high. Therefore, there is a need in the art to improve the production process thereby to obtain high quality foundry coke at a higher yield or a lower cost. Traditionally made coke typically has an ash fusion temperature (AFT) above 2650 degrees Fahrenheit (° F.). Due to this high temperature, the ash melts deeper in the cupola which reduces the available surface area for coke exposed to molten metal. As a result, less carbon is transferred to the iron.

The coke products disclosed herein for the present technology have an AFT lower than 2600° F. and therefore melt higher in the cupola, thereby increasing the amount of carbon surface exposed to the molten metal. Moreover, from a viscosity standpoint, a low AFT allows the melted ash to move through the carbon bed more quickly and results in a better phase separation in the well section of the cupola to allow more carbon and molten metal contact. As used herein, the term "molten metal" refers to molten iron, molten steel, or the final molten mixture of molten iron and molten steel.

An AFT can be obtained in various ways and can be separated into different types of AFTs. In some embodiments, an AFT can be measured from a sample of ash created by burning a coal, coal blend, or coke product to completion. The ash elemental analysis can be performed on each element, for example, individual silicon atoms create a signal in the analytical instrument. To obtain a mass percentage value used for model ash fusion calculation, some embodiments of the present technology can treat all elements as fully oxidized and determine a mass percentage is based oxidized forms. For example, some embodiments of the present technology can determine the $SiO_2$ mass but not the Si mass. In some embodiments, the mass percentages of $SiO_2$, $Al_2O_3$, $FeO_3$, CaO, other compounds, etc., can be normalized to sum up to 100%.

Alternatively or additionally, an AFT can be measured by an AFT test, such as a standard American Society for Testing and Materials (ASTM) method D1857. For example, some embodiments of the present technology can determine an initial deformation temperature (IDT), softening temperature (ST), hemispherical temperature (HT), and flow temperature (FT). These measured temperatures can have different values with respect to each other, and can be used to characterize a particular coal, coal blend, or coke product. Furthermore, as discussed elsewhere, the composition of the ash remaining from combustion of a coal or coal blend is considered to be the same as the ash remaining after combustion of a coke product produced from the coal or coal blend. Some embodiments can characterize a coal blend ash composition as the weighted average of the ash compositions of the coal components weighted by their respective mass fractions in the coal blend.

Further, traditional operation can also add $CaCO_3$-containing rocks to the charge to use as a flux to remove ash. The $CaCO_3$ penetrates into the ash to lower the AFT, or the ash itself dissolves into the $CaCO_3$ containing rocks. Given the very low surface to volume ratio for the fluxing to occur, this is an inefficient way to introduce a fluxing agent. Based on the unexpected discovery of the impact of a low AFT on the desired carbon transfer disclosed herein, the coke can be "pre-fluxed" by selecting coals or coal blends having ashes that are proportionally higher in the low melting oxides, such as CaO, MgO, $Fe_2O_3$, $Na_2O$, and $K_2O$, than in the high melting oxides of $Al_2O_3$ and $SiO_2$.

In a foundry cupola, coke is used as a fuel and carbon source to produce cast iron. Coke provides four functions in the cupola: (1) providing heat from the combustion to melt the iron or steel; (2) supplying carbon to the iron; (3) providing structural support for the iron or steel burden; and (4) creating gas permeable layers that allow the gases to travel upward and spread to provide good contact with the iron or steel.

Some embodiments can perform operations described in this disclosure to produce coke products that permit a higher carbon transfer rate to the iron or steel during foundry operations, which can result in better cupola performance. Some embodiments can use one of various types of ovens to produce coke products, such as a heat recovery oven, a non-recovery oven, a Thompson oven, another type of horizontal oven, a vertical byproduct oven, etc. Some embodiments can produce coke products described in this disclosure using one or more operations described in U.S. patent application Ser. No. 17/736,960, titled "FOUNDRY COKE PRODUCTS, AND ASSOCIATED SYSTEMS AND METHODS," the disclosure of which is incorporated by reference herein in its entirety.

II. Coal Blends for Producing Foundry Coke Products, and Associated Systems and Methods Some embodiments of the present technology can perform operations to increase the efficiency of coke product production operations in a manner that can reduce energy consumption and increase yield. These operations can include determining the composition of coal blends used to produce a coke product, where the composition of a coal blend can include coals from different coal sources. Some embodiments can select specific coals for their VM content, where VM content and distribution can determine affect coke product yield, coke product properties, etc. Some embodiments can further perform specific processes when producing a coke product with a coke oven, where such processes can include opening or closing valves of a coke oven to maintain certain temperature relationships within sections of the coke oven. These outputs can result in coking products that are unique in comparison to other coking products with respect to reactivity, size, or other properties.

FIG. 1 shows an illustrative system 100 for obtaining coal parameters for multiple coal types 112-116 (collectively referred to as "coals 110") and determining a coal blend 140 formulation, in accordance with one or more embodiments. Various facilities and equipment can be used to blend the 110 coals from various sources to form the coal blend 140. In some embodiments, not all of the coal types shown in FIG. 1 are utilized to form the coal blend 140 (e.g., only type A coal 112 and type B coal 113 are used). Each of the coals 110 can be tested using a coal parameter measurement system 120 to determine coal parameters, such as a VM mass fraction, ash composition measurement, sulfur composition measurement, inert matter composition, etc. Some embodiments can also use other properties of the coal, such as a fluidity of tar in the coal, and AFT for the coal, vitrinite reflectance, etc., when selecting the type or amount of coals to use for a coal blend. Alternatively or additionally, some embodiments of the present technology can obtain coal parameters from a third-party data source (e.g., a database application program interface (API), or a user's manual input into an input device, such as a keyboard or touchscreen, etc.).

In some embodiments, the coal parameters can consider measurements of reactive components or subtypes of reactive components, such as vitrinite, liptinite, and reactive semifusinite. The coal parameters can also include measurements or select an amount of inert material to include into a coal blend, such as breeze, inert semifusinite, fusinite, macrinite, and mineral matter. In some embodiments, the inert content of a coal blend can be greater than or equal to 32.0%, or can be restricted to a particular range, such as between 28.0%-40.0%, or between 33.0%-35.0%. Some embodiments can determine the type and quantity of coals, breeze, and other components of a coal blend to satisfy a set of target coal blend parameters or corresponding target coke blend parameter, such as a target coal blend parameter, indicating a strong uniform coke. For example, some embodiments of the present technology can select the types of vitrinites that are present in a coal blend, where the types of vitrinite can include one or more of V9, V10, V11, V12, V13, V14, V15, V16, V17, V18, and V19. Furthermore, some embodiments of the present technology can produce coal blends having parameters described in U.S. patent application Ser. No. 17/736,960, titled "FOUNDRY COKE PRODUCTS, AND ASSOCIATED SYSTEMS AND METHODS".

After obtaining coal parameters for the coals 110, some embodiments of the present technology can determine combinations of coal types of the coals 110. For example, a first combination of coal types can include 20% type A coal 112, 30% type B coal 113, 40% type C coal 114, and 10% type D coal 115. Some embodiments can represent each combination of coal types with a vector in an n-dimensional mixture space, where "n" can represent an integer equal to or less than the number of available coal types usable to generate a coal blend. For example, some embodiments of the present technology can represent the first combination with a vector [0.2, 0.3, 0.4, 0.1] to represent a mixture point, where the mixture point can indicate the proportional amount of each coal in the coal blend. Furthermore, some embodiments of the present technology can add additives to a coal blend. Such additives can include calcium oxide, limestone, a calcium-containing material, trona, soda ash, caustic soda, slag (e.g., low ash fusion slag, a basic oxygen furnace (BOF) slag, a cupola slag, etc.), iron, nickel, potassium, magnesium, sodium, calcium sulfate, rockwool, biochar, or biomass (e.g., a low-AFT biomass). Alternatively or additionally, some embodiments of the present technology can add mineral additives, such as dolomite, various other calcium-containing minerals, iron-containing minerals, magnesium-containing minerals, or sodium-containing minerals. Some embodiments can use metal oxides as additives to a coal blend, such as $Al_2O_3$, $SiO_2$, $Fe2O_3$, MgO, $Na_2O$, or TiO, transition metal oxides, calcined minerals. Some embodiments can add metal halide additives, such as $CaCl_2$, $MgCl_2$, NaCl. Some embodiments can add metal sulfates additives to a coal blend, such as $CaSO_4$. Some embodiments can add aluminum or silicon mineral additives to a coal blend, such as Quartz, Muscovite, or Feldspar. Some embodiments can add additives from industrial waste or recycling streams, such as blast furnace slag, foundry cupola slag, metal fines, wallboard waste, flue gas desulfurization plant gas byproduct (e.g., fly ash), coal burning plant fly ash, heat recovery steam generator wash mud, or unwashed coal.

Once an additive is added, the coal blend can have a calcium mass fraction, a lime mass fraction, a trona mass fraction, a soda ash mass fraction, a caustic soda mass fraction, a low ash fusion slag mass fraction, a BOF slag mass fraction, a cupola slag mass fraction, an iron mass fraction, a nickel mass fraction, a potassium mass fraction, a magnesium mass fraction, a sodium mass fraction, a calcium sulfate mass fraction, a rockwool mass fraction, a biochar mass fraction, a biochar mass fraction, a biomass mass fraction, or another additive mass fraction that is greater than 0% but less than a predetermined threshold. The threshold can vary based on particular embodiments, and can be configured such that the additive mass fraction is less than 10.0%, less than 5.0%, less than 3.0%, less than 1.0%, etc. By using a small amount of the additives, some embodiments of the present technology can significantly lower an ash fusion value or another property that increases the efficiency of a coke product. Alternatively or additionally, some embodiments of the present technology can include a greater amount of additives, where the coal blend can include more than 10.0% of an additive. For example, some embodiments of the present technology can use an additive having a calcium oxide mass fraction greater than 70.0%, where inclusion of the additive can raise a calcium oxide mass fraction of a coal blend to be greater than 10.0%. Unless otherwise indicated, an element mass fraction can refer to the element itself, compounds containing the element, or both. For example, a calcium mass fraction can refer to a mass fraction of only calcium in a material, a mass fraction of calcium oxide, or a mass fraction of another calcium-containing compound, or a combined mass fraction of any combinations thereof, etc.

In many cases, the VM of coal includes vitrinite, where vitrinite can be categorized based on its reflectance or other physical properties. Some systems can categorize vitrinite by vitrinite types V8 to V18, where different coals can include different distributions of vitrinite types. As used in this disclosure, a high volatility coal can be characterized by having a VM mass fraction that is greater than a VM mass fraction threshold, where different systems can define a high volatility coal using different threshold. For example, some embodiments of the present technology can characterize a high volatility coal as a coal having a VM mass fraction that is greater than or equal to 28.0%. Some embodiments can use other VM mass fraction thresholds to characterize a high volatility VM, such as 25.0%, 27.0%, 30.0%, 31.0%, or some other threshold greater than or equal to 25.0%.

As used in this disclosure, a low volatility coal can be characterized by having a VM mass fraction that is less than a VM mass fraction threshold, where different systems can define a low volatility coal using different thresholds. For example, some embodiments of the present technology can characterize a low volatility coal as a coal having a VM mass fraction that is less than or equal to 20.0%, though a different value other than 20% can be used, such as 14.0%, 15.0%, 17.0%, 21.0%, etc. Some embodiments of the present technology can use other VM mass fraction thresholds to characterize a high volatility VM as a VM greater than the mass fraction threshold. The mass fraction threshold can be equal to a value such as 14.0%, 15.0%, 21.0%, 22.0%, 23.0%, or some other threshold less than or equal to 25.0%.

Some embodiments of the present technology can characterize or partially characterize a low volatility coal with respect to a high volatility coal by using a pre-determined difference, where the pre-determined difference can include a value greater than 1.0%, such as 2.0%, 3.0%, 4.0%, 8.0%, or some other value. For example, some embodiments of the present technology can set the difference between a first threshold used as the threshold for a high volatility coal and a second threshold used as the threshold for a low volatility coal as being equal to 4.0%, where a selection of 30% as the first threshold can cause a system to automatically select 26% as the second threshold. Alternatively, some embodiments of the present technology can determine or permit an alternative value to be the second threshold, such as 21%. By setting the thresholds used to define a high volatility coal and a low volatility coal or defining a difference between the two thresholds, some embodiments of the present technology can also automatically define a middle volatility coal as those coals that are not high volatility coals or low volatility coals.

This disclosure refers to the AFT of coal blends or coke products. An AFT of a coke product can be determined in various ways, such as via experimental observation (observed AFT) or determined using an empirical model (model AFT). Unless otherwise specified, the term "ash fusion" can refer to either an empirical model for ash fusion or an observed ash fusion. As will be discussed elsewhere, an AFT can be less than or equal to 2600° F., less than or equal to 2450° F., less than or equal to 2400° F., less than or equal to 2350° F., less than or equal to 2300° F., less than or equal to 2250° F., less than or equal to 2200° F., less than or equal to 2150° F., less than or equal to 2100° F., less than or equal to 2050° F., less than or equal to 2000° F., less than or equal to 1950° F., less than or equal to 1900° F., less than or equal to 1850° F., or less than or equal to 1800° F.

In some embodiments, an empirical model of AFT can be determined from remaining compounds of an ash generated from combustion of a coke product. When the value of the AFT is constrained to a range, these empirical models can serve to form a composition boundary in a multi-dimensional composition parameter space. The composition parameters of the parameter space can represent amounts of an element or compound in a material or group of materials, where the amounts can include compound mass fractions of their corresponding compounds, volumetric fractions, etc. By using different empirical models or different ranges for an AFT, some embodiments constrain the ash of a coke product to different regions in a composition parameter space, which can then constrain the composition of the coke product itself. For example, empirical models for the ash fusion can be defined in Equations 1-3 below, where "AFT" can be a model ash fusion temperature in degrees Celsius (° C.), "$SiO_2$_mass_fraction" can be a $SiO_2$ mass fraction of the ash of the coke product ("coke product ash"), "$Al_2O_3$_mass_fraction" is a $Al_2O_3$ mass fraction of the coke product ash, "$Fe_2O_3$_mass_fraction" is a $Fe_2O_3$ mass fraction of the coke product ash; "CaO_mass_fraction" is a CaO mass fraction of the coke product ash; "MgO_mass_fraction" is a MgO mass fraction of the coke product ash; and "$K_2O$_mass_fraction" is a $K_2O$ mass fraction of the coke product ash:

$$AFT=19\times(Al_2O_3_mass_fraction)+15\times(SiO_2_mass_fraction+TiO_2_mass_fraction)+10\times(CaO_mass_fraction+MgO_mass_fraction)+6\times(Fe_2O_3_mass_fraction+Na_2O_mass_fraction) \quad \text{Equation 1}$$

$$AFT=19\times(Al_2O_3_mass_fraction)+15\times(SiO_2_mass_fraction+TiO_2_mass_fraction)+10\times(CaO_mass_fraction+MgO_mass_fraction)+6\times(Fe_2O_3_mass_fraction+Na_2O_mass_fraction+K_2O_mass_fraction) \quad \text{Equation 2}$$

$$AFT=401.5+(26.3\times SiO_2_mass_fraction+40.7\times Al_2O_3_mass_fraction)-11.0\times Fe_2O_3_Mass_Fraction-7.9\times CaO_mass_fraction-112\times MgO_mass_fraction \quad \text{Equation 3}$$

Some embodiments can apply different models based on different compositions. For example, based on a determination that an $Al_2O_3$ and $SiO_2$ mass fraction in the ash composition of a coal blend is between 65% and 80%, some embodiments of the present technology can use Equation 3 to compute a model AFT, and use Equation 2 to compute the model AFT otherwise. Some embodiments can use different models for different optimization operations. For example, some embodiments of the present technology can use Equation 3 to optimize a coal blend selected for coke production to have a lower content of $Al_2O_3$ and $SiO_2$ while having a greater content of $Fe_2O_3$ and CaO. Furthermore, while some embodiments of the present technology can use a known model AFT, some embodiments of the present technology can use novel model AFT equations. For example, some embodiments of the present technology can use Equation 1 to determine an AFT, where Equation 1 can be found in Chapter 8 of *Cupola Handbook,* 6th ed., ©1999, American Foundrymen's Society, Inc., which is incorporated by reference herein, some embodiments of the present technology can use other AFT models, such as those described by Equation 2 or Equation 3. Various other limitations on the mass fractions of components of a coal blend can be imposed. For example, some embodiments of the present technology can produce a coal blend having an alumina $Al_2O_3$ content of ash of a coal blend as being less than 10.0%, less than 7.0%, less than 6.0%, less than 5.0%, etc.

By constraining an AFT to a specific boundary, some embodiments of the present technology can restrict the composition of an ash. In some embodiments, the specific boundary can encompass a temperature region such as 982° C. (1800° F.) to 1204° C. (2200° F.), 1204° C. (2200° F.) to 1426° C. (2600° F.), or 982° C. to 1426° C. If the ash is an ash product generated by combusting a coke product, restrictions on the composition of the ash results in a constraint on the coke product of the coke product itself. For example, some embodiments of the present technology can generate a coke product having certain amounts of Al, Si, Ti, Ca, Mg, Fe, Na, or K such that combustion of the coke product results in an ash having the composition that satisfies Equation 2. Various composition boundaries on a coke product ash can be used. For example, some embodiments of the present technology can generate a coke product such that a model AFT of the coke product as determined by Equation 3 is within an AFT boundary. For example, the AFT boundary can be a temperature range between 1260° C. (2300° F.) and 1427° C. (2600° F.), between 1260° C. and 1371° C. (2500° F.), between 1260° C. and 1316° C. (2400° F.), or between 1260° C. and 1427° C. In some embodiments, a lower bound on the temperature can be a different value, such as 982° C. (1800° F.) or a value less than 1288° C., such as 816° C. (1500° F.), 649° C. (1200° F.), or some other value less than 1288° C.

Furthermore, some embodiments of the present technology can constrain an AFT to be approximately a target value, wherein a parameter is approximately a target value if the parameter is within 10% of the absolute value of the target value. For example, some embodiments of the present technology can constrain an AFT to be approximately 982° C. (1800° F.), 1204° C. (2200° F.), 1260° C. (2300° F.), 1288° C. (2350° F.), 1316° C. (2400° F.), 1343° C. (2450° F.), 1371° C. (2500° F.), 1399° C. (2550° F.), or 1427° C. (2600° F.).

In some embodiments, a coal blend formulation can include specific properties, such as an ash fusion value less than or equal to 2400° F., which is equivalent to being less than 1316° C. Some embodiments can recommend or produce a coal blend that contains low-VM mass fraction coals and high-VM mass fraction coals without necessarily including middle-VM mass fraction coals. For example, a coal blend can have a bimodal profile of high-VM and low-VM coals within the coal blend. In such a bimodal profile, the coals of a coal blend can include only first and second sets of coals, where a first set of coals of the coal blend can include only high-VM coals having a VM mass fraction greater than 30.0%, and a second set of coals of the coal blend can include only low-VM coals having a VM mass fraction less than 22.0%.

Some embodiments can map the mixture point to a corresponding coal parameter point in a coal parameter space ("coal parameter point"), where each dimension in the coal parameter space can represent a coal parameter. In some embodiments, a dimension of a coal parameter point can be determined as a linear combination of the coals 110 weighted by the values of the corresponding mixture point. For example, a coal blend can include a two-coal-type mixture that includes 50% type A coal 112 and 50% type B coal 113. If the type A coal 112 has a VM mass percentage equal to 15% and the type B coal has a VM mass percentage equal to 25%, the VM mass percentage of the coal blend can be equal to the mean average of the two VM mass percentages, 20%.

Some embodiments can obtain a set of target coal parameters, where a target coal parameter can be provided as a default value, provided by manual data entry, obtained from a third-party data store, provided via an electronic message, etc. For example, the target coal parameter can include a coke reactivity index (CRI) or a coke strength after reaction (CSR) value. In some embodiments, the CRI or CSR can be manually entered by a user, obtained from a database, received via an API, etc. Some embodiments can use a model based on a set of coal parameters to determine a corresponding set of coke parameters. The model can include a statistical model, a semi-empirical analytical model, a neural network model, a physical simulation model, etc. As described elsewhere in this disclosure, some embodiments of the present technology can use a model that accounts for non-linear relationships between coal parameters and coke parameters. For example, some embodiments of the present technology can use a neural network, such as feed forward neural network, to predict a set of coke parameters.

In some embodiments, the neural network can be trained with past data. For example, some embodiments of the present technology can train a neural network based on past blends and outcomes of the blends where the outcomes can include coke properties such as a CSR, a percentage weight loss, a CRI, or another coke parameter that is non-linear with respect to a related coal parameter. Alternatively, or additionally, some embodiments of the present technology can use an analytical physics-based model or semi-analytical model to predict a coke parameter. The use of a neural network, or other non-linear methods to predict coke parameters based on coal parameters can be advantageous due to non-linear effects associated between coal parameters and coke parameters. Furthermore, some embodiments of the present technology can provide additional inputs to the neural network model, such as a breeze parameter, an amount of breeze used, etc.

Some embodiments can adapt to changes in the availability of different coal types. For example, a source mine for type A coal 112 can be shut down, a transportation line carrying type A coal 112 can be significantly delayed, a regulatory environment can make the use of certain coals infeasible for use, etc. In response to a determination that a coal type used in a coal blend is unavailable or expected to become unavailable, some embodiments of the present technology can generate an alternative coal blend formulation that maps to a position in a coal parameter space that is within a distance threshold of a first point in the coal parameter space. For example, some embodiments of the present technology can originally use a first coal blend that is 20% type A coal by weight, where the first coal blend maps to a first point in a coal parameter space that includes a VM mass ratio of 25%, a sulfur mass ratio of 0.4%, and ash mass ratio of 6%, etc. After receiving a message indicating that type A coal is restricted to 5% (e.g., as a result of an inventory drop), some embodiments of the present technology can perform a set of operations to determine one or more additional combinations that satisfy the coal type use restrictions and the coal parameter space. In cases where the first coal parameter point is not achievable while constrained by coal type availability, some embodiments of the present technology can determine an alternative coal blend formulation that maps to a coal parameter point that is within a coal parameter space distance threshold of the first coal parameter point.

Some embodiments can use the mixture point to determine mixture of coals to add and process for the coal blend 140. For example, some embodiments of the present technology can use operations described in this disclosure to determine a mixture point indicating a coal mixture that includes 20% type A coal 112, 30% type B coal 113, 40% type C coal 114, and 10% type D coal 115 and combine coal in these respective proportions into the coal blend 140. Some embodiments can then provide the mixed coal into a coke oven 150, where some embodiments of the present technology can add coke breeze 111 to the coke oven 150 to create a coke product having coke properties similar to or the same as a set of target coke properties.

Figure 2:
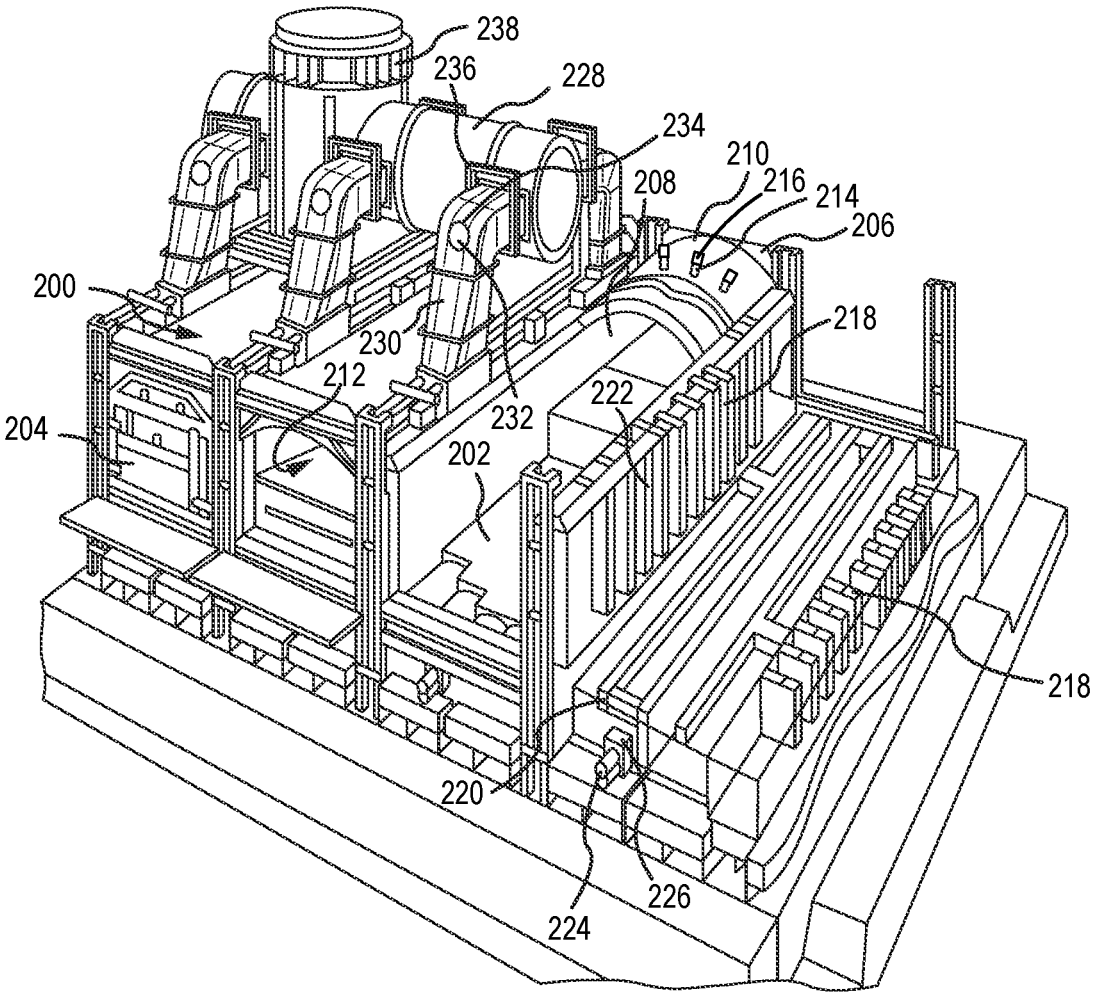
FIG. 2 depicts an isometric, partial cut-away view of a portion of a horizontal heat recovery coke plant, in accordance with one or more embodiments of the present technology.

FIG. 2 depicts an isometric, partial cut-away view of a portion of a horizontal heat recovery coke plant, in accordance with one or more embodiments of the present technology. An oven 200 of the coke plant can include various ducts, chambers, valves, sensors, or other components described in U.S. patent application Ser. No. 17/736,960, titled "FOUNDRY COKE PRODUCTS, AND ASSOCIATED SYSTEMS AND METHODS." For example, the oven 200 can include an open cavity defined by an oven floor 202, a pusher side oven door 204, a coke side oven door 206 opposite the pusher side oven door 204, opposite sidewalls 208 that extend upwardly from the oven floor 202 and between the pusher side oven door 204 and coke side oven door 206, and an oven crown 210, which forms a top surface of the open cavity of an oven chamber 212. Furthermore, the oven 200 can include a set of crown air inlets 214 that allows primary combustion air into the oven chamber 212. In some embodiments, the set of crown air inlets 214 can penetrate the oven crown 210 and permit open fluid communication between the oven chamber 212 and the environment outside the oven 200. In some embodiments, air flow through air inlets or air ducts (e.g., an uptake duct) can be controlled by dampers, which can be configured at any of a number of states between a fully open state and a fully closed state to vary an amount of air flow. For example, the crown air inlets 214 can include a damper that can be configured into different states to permit air flow into the oven crown 210, such as a crown inlet air damper 216, that operate in a similar manner. While embodiments of the present technology can use crown air inlets 214, exclusively, to provide primary combustion air into the oven chamber 212, other types of air inlets, such as the door air inlets, can be used in particular embodiments without departing from aspects of the present technology.

As discussed above, control of the draft in the oven 200 or other operations in the oven 200 can be implemented by control systems using operations described in U.S. application Ser. No. 17/736,960, titled "FOUNDRY COKE PRODUCTS, AND ASSOCIATED SYSTEMS AND METHODS." Such operations can include operations of a coking cycle, which can include charging a coal blend into the oven 200, controlling the uptake damper 236 to be configured at any one of a number of states between fully open and fully closed, etc. Upon completion of the coking cycle, some embodiments of the present technology can coke out a coal blend to produce a coke product useful for producing steel with a cupola furnace. In some embodiments, foundry coke products may be used in a cupola furnace using operations described in U.S. patent application Ser. No. 18/052,739, titled "FOUNDRY COKE PRODUCTS AND ASSOCIATED SYSTEMS AND PROCESSING METHODS VIA CUPOLAS", the disclosure of which is incorporated herein by reference in its entirety. In some embodiments, the coke product can be removed from the oven 200 through the coke side oven door 206 with a pusher ram or another mechanical extraction system. In some embodiments, the coke can be quenched (e.g., wet or dry quenched) and sized before delivery to a user.

Figure 3:
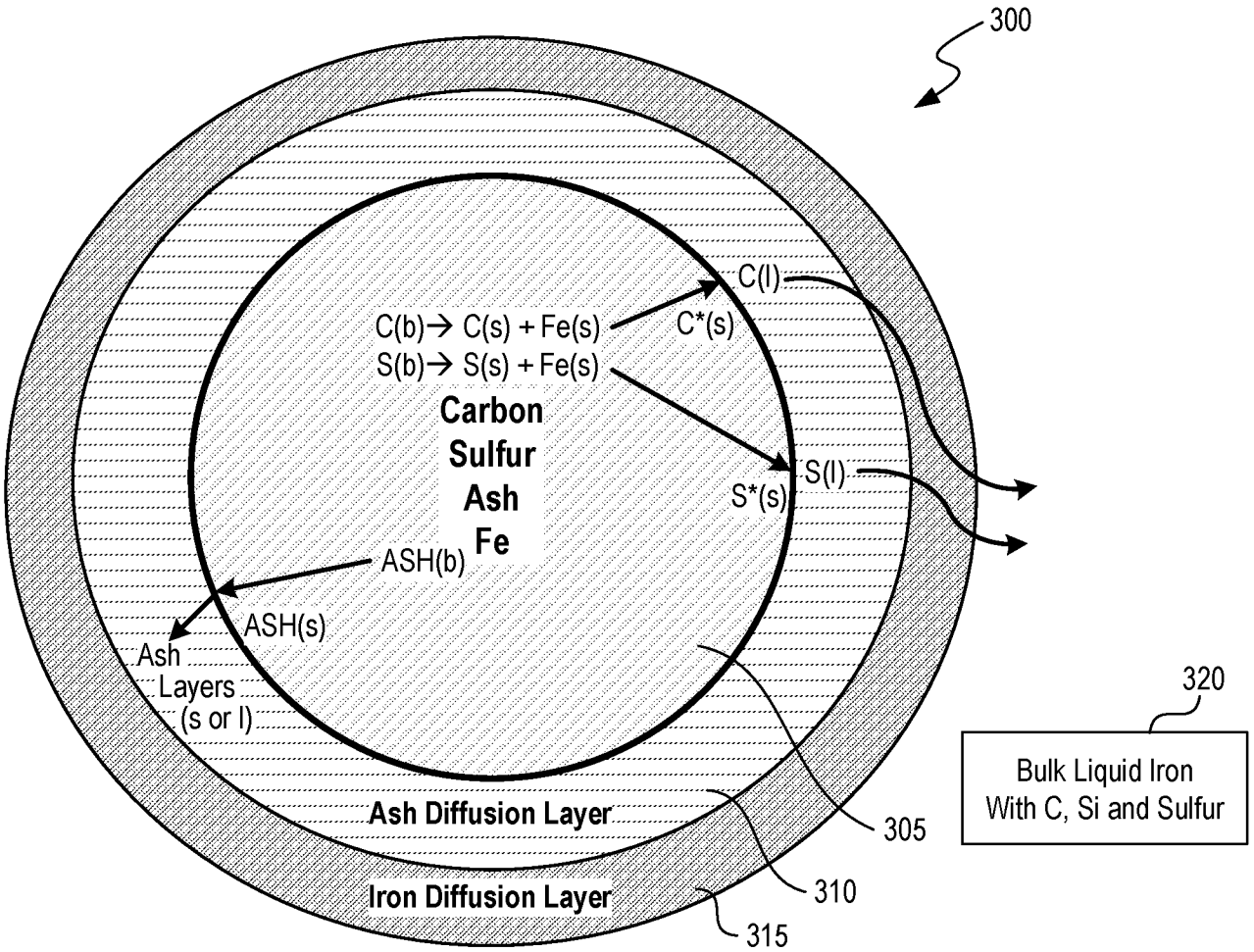
FIG. 3 illustrates a coke particle configured to be heated in a foundry cupola, in accordance with one or more embodiments of the present technology.

III. Foundry Coke Products, and Associated Systems, Devices, and Methods illustrates a coke particle configured to be heated in a foundry cupola, in accordance with one or more embodiments of the present technology. As shown in FIG. 3, C(b)=carbon bulk, S(b)=sulfur bulk, Ash (b)=ash in bulk, C(s)=surface carbon, S(s)=surface sulfur, Ash(s)=surface ash (which builds up from the shrinking core), Fe(s)=surface Fe, C*(s)=active carbon surface, FeC, S*(s)=active sulfur surface, FeS, C(l)=carbon in liquid, and S(l)=sulfur in liquid. The coke particle 300 includes a core 305 that shrinks due to carbon dissolution in a cupola, where the coke particle 300 can be surrounded by a bulk liquid 320. As the core 305 of the coke particle 300 shrinks, e.g., due to oxidation and/or combustion of the carbon of the coke particle 300, diffusion layers comprising ash and iron that are radially outward of the core 305 begin to form. For example, the coke particle 300 can include a first or ash diffusion layer 310 ("first diffusion layer 310") comprising ash that is radially outward of the core 305 and at least partially surrounds the core 305, and a second or iron diffusion layer 315 ("second diffusion layer 315") that is radially outward of the core 305 and first diffusion layer 310 and at least partially surrounds the first diffusion layer 310.

The first diffusion layer 310 layer can be solid or liquid, and can effectively block the coke surface, or lower the mass transfer area across the coke surface into the surrounding liquid metal. Additionally or alternatively, the first diffusion layer 310 enables oxidation and/or combustion of the carbon of the coke particle to be time and/or temperature delayed, such that the coke does not produce carbon monoxide in the drying region and instead is oxidized and combusted in the reaction region of the cupola. The first diffusion layer 310 comprising ash is formed in part due to the ash fusion temperature of the coke product, which is directly correlated to the composition of the coke particle 300. As described elsewhere herein, the ash fusion temperature of the coke is lower than traditional coke products, and can no more than 2650° F., 2600° F., 2550° F., 2500° F., 2450° F., 2400° F., 2350° F., 2300° F., 2250° F., 2200° F., 2150° F., 2100° F., 2050° F., 2000° F., 1950° F., 1900° F., 1850° F., or within a range of 1800-2600° F., 1800-2500° F., 1900-1300° F., or 2000-2200° F. This relatively low ash fusion temperature can enable formation of the diffusion ash layer, e.g., in the drying region of the cupola, that prevents cooking of the coke, or more particularly the core 305, prior to the reaction region. Additionally or alternatively, this relatively low ash fusion temperature can optimize contact time between the coke 300 and the metal within the cupola once the metal melts and becomes molten at the reaction region of the cupola. As a result, more carbon can be transferred from the coke 300 to the metal. This is in contrast to conventional coke products, which can have a higher ash fusion temperature that results in ash being formed deeper (i.e., downstream) of the reaction region and thus limits the contact time between the coke and the molten metal, thereby resulting in relatively less carbon transfer.

The second diffusion layer 315 is formed as the coke particle 300 is heated within the cupola and the coke core 305 shrinks. The second diffusion layer can further limit cooking of the coke within the drying region and/or help ensure the vast majority of combustion and oxidation of the coke does not occur until the coke 300 reaches the reaction region. Additionally or alternatively, carbon and sulfur may compete with one another to pass through the second diffusion layer 315. That is, the presence of sulfur can undesirably decrease the transfer rate of carbon from and out of the coke 300. In some embodiments, the coke can be pre-fluxed and/or include (e.g., doped with) an additive (e.g., calcium, iron, calcium oxide, magnesium oxide, iron oxide, sodium oxide, and potassium oxide, and/or other oxides having a relatively low melting point) that acts as a catalytic material. As an example, sodium can act as a pre-fluxing agent, and iron can act as a pre-fluxing and catalytic agent. The catalytic material can trap sulfur and therein be utilized to flux the sulfur out of the coke. In some embodiments, the pre-fluxed coke is a result of selecting coals to produce the coke that have ash materials proportionally higher in the oxides described above. This is in contrast to coke products that may add calcium oxide or calcium carbonate particles/rocks as a flux to remove ash, as such methods are inefficient due to the very low surface to volume ratio for the fluxing to actually occur. Additionally, the pre-fluxed coke and/or catalytic agents can promote the carbon deposition via the Boudouard reaction, thereby generating more heat and increasing the amount of carbon that is present within the reaction region (e.g., the combustion zone) of the cupola. Without being bound by theory, the pre-fluxing agents can alter the liquidus temperature of the slag (e.g., slag 116; FIG. 1) or, more particularly, can alter the liquidus temperature of the ash at the surface or interior of the coke that is blended into the bulk slag.

Improved coke chemistry aims at increasing carbon dissolution from the coke particle 300 into the metal (i.e., the iron or steel) within the cupola. In operation, as carbon dissolves into the bulk liquid iron within the cupola, the coke core 305 shrinks and the ash and impurities are built up at the surface. Additionally, carbon and sulfur both dissociate from the surface, which can be aided by catalytic activity of Fe, Ni and other metals. A lower ash melting temperature, represented by an ash fusion temperature (as described elsewhere herein), allows improved ash removal by faster conversion of ash into a liquid phase and reduces ash resistance. Carbon and sulfur diffuse through the thin iron diffusion layer. Additionally, carbon and sulfur are competitive and resistant to dissolving or transferring of each other. As such, a low sulfur content of the coke improves carbon transfer. In addition, coke products having a high coke reactivity index (CRI) or a low coke strength after reaction (CSR) (as described elsewhere herein) allows more reactive carbon forms to dissociate from the surface thereby increasing the carbon dissolution rate.

Various metals added to a foundry coke product produced from a coal blend via ash in the coal blend or otherwise introduced into the foundry coke product can provide catalytic functions that increases a carbon dissolution rate. In some embodiments, a multi-oxidation state element (e.g., a metal) may change oxidation states in a coke product to provide catalytic activity. For example, a coke product may include sodium, which may transition from an unoxidized state Na into a first ionic oxidation state $Na^{+}$. Alternatively, or additionally, a coke product may include iron, which may transition from an unoxidized state Fe into the oxidized states $Fe^{2+}$ or $Fe^{3+}$. Furthermore, the coke product may include the multi-oxidation state elements in an oxidized form. For example, the coke product may include $Na^+$ in the form of a salt or $Fe^{3+}$ in the form of $Fe_2O_3$. The coke product may also include other types of metals, such as nickel, copper, etc. The catalytic material embedded in the coke product increases carbon dissolution during steel production because at least some of the catalytic material will remain in contact with the interface between the coke product and a liquid iron bath during steel production.

Figure 4:
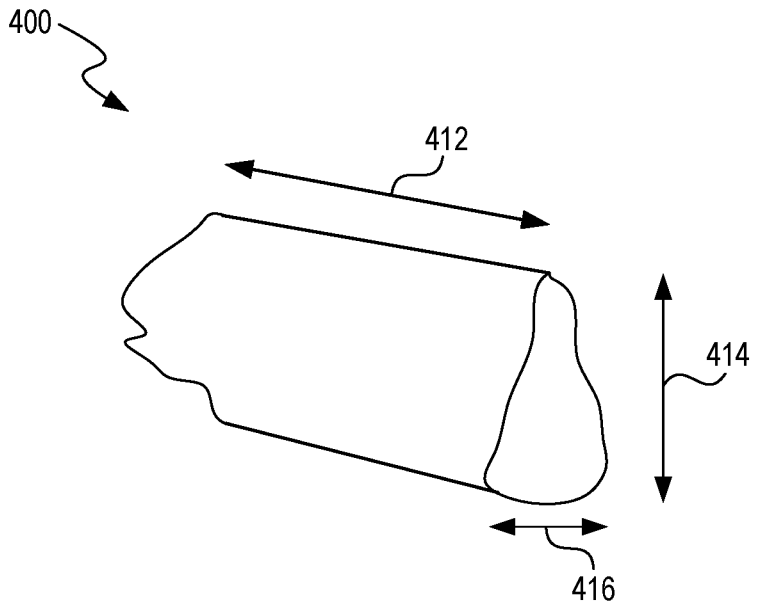
FIG. 4 depicts an example foundry coke product and a table of foundry coke properties, in accordance with one or more embodiments of the present technology.

FIG. 4 depicts an example foundry coke product and a table of foundry coke properties, in accordance with one or more embodiments of the present technology. Some embodiments can use a coke oven, such as the oven 200 of FIG. 2, to produce a foundry coke product 400. In some embodiments, the foundry coke product 400 may be generally oblong shaped and can have different or similar dimensions along a first length 412, a second length 414, or a third length 416. For example, the first length 412 can be greater than 6.0 inches (e.g., 9.0 inches), the second length can be greater than 2.5 inches (e.g. 4.0 inches), and the third length can be greater than 2.5 inches (e.g., 4.0 inches). In some embodiments, one or more lengths of the shape of the foundry coke product 400 can be limited to a maximum value. For example, the first length 412 can be between 6.0 inches and 12.0 inches.

Due to variations in the specific shape of foundry coke products, a foundry coke product can be characterized by a range of hydraulic diameters. For example, the foundry coke product 400 can have a hydraulic diameter that is greater than or equal to 1.0 inches, greater than or equal to 2.0 inches, or greater than or equal to 3.0 inches, etc. In some embodiments, the hydraulic diameter of a foundry coke product can be greater than an actual diameter of the foundry coke product due to the cross-sectional geometry of the foundry coke product.

The table 450 includes a set of attributes of the foundry coke product 400. The attributes of foundry coke products shown in the table 450 can characterize coke products produced by the operations described in this disclosure. Such attributes can be advantageous for foundry operations, such as having lower AFT values in comparison to conventional coke products. Such lower AFT values can be represented in various forms, such as the IDT or ST values. For example, sample "S4" shown in the table 450 has an ash fusion IDT equal to 2150° F. (1177° C.). Some embodiments can perform operations to reduce a low ash fusion to a coke product based on an AFT threshold or target ash fusion range.

In some embodiments, a target AFT value or AFT range can vary based on the type of ash fusion value being used. In some embodiments, a produced coke product can have an IDT that is between 2100° F. and 2400° F. Some embodiments can include stricter limits on coke products. For example, some embodiments of the present technology can include a coke product having an IDT that is between 2100° F. (1149° C.) and 2250° F. (1232° C.). Some embodiments can change coal blends, soak times, or durations at different damper positions to satisfy a target IDT. For example, some embodiments of the present technology can select a coal blend or determine oven operations based on a target IDT value of approximately 2100° F., approximately 2150° F., approximately 2200° F., approximately 2250° F., approximately 2300° F., approximately 2350° F., or approximately 2400° F. In some embodiments, a soak time can be established as starting after a peak crown temperature or other peak temperature is reached. Alternatively, a soak time can be established as starting after a sole flue temperature or crown temperature begins decreasing without any gas flow. Furthermore, the soak time can be reduced due to the increased coking time of a pyrolysis duration, where the soak time can be less than 10.0 hours, less than 5.0 hours, or even less than 1.0 hour. Furthermore, some embodiments of the present technology can use various total cycle times, and can characterize an operation based on a ratio of a soak time to a pyrolysis duration, where the ration can be less than 33.0%, less than 15.0%, less than 5.0%, or less than some other threshold that is less than 50%.

Similarly, some embodiments of the present technology can produce coke products using operations described in this disclosure having an ST that is within a specified range, such as between 2150° F. and 2500° F. Some embodiments can implement operations that satisfy a stricter range for an ST, such as modifying operations to produce coke products having an ST between 2150° F. and 2300° F. Furthermore, some embodiments of the present technology can change coal blends, soak times, or durations at different damper positions to satisfy a target ST. For example, some embodiments of the present technology can select a coal blend or determine oven operations based on a target ST value of approximately 2100° F., approximately 2150° F., approximately 2200° F., approximately 2250° F., approximately 2300° F., approximately 2350° F., approximately 2400° F., approximately 2450° F., or approximately 2500° F. Furthermore, some embodiments of the present technology can set a target IDT value as a function of a target ST value.

Similarly, some embodiments of the present technology can produce coke products using operations described in this disclosure having an HT that is within a specified range, such as between 2200° F. and 2350° F. Some embodiments can implement operations that satisfy a stricter range for an HT, such as modifying operations to produce coke products having an HT between 2150° F. and 2300° F. Furthermore, some embodiments of the present technology can change coal blends, soak times, or durations at different damper positions to satisfy a target HT. For example, some embodiments of the present technology can select a coal blend or determine oven operations based on a target HT value of approximately 2200° F., approximately 2250° F., approximately 2300° F., approximately 2350° F., approximately 2400° F., approximately 2450° F., or approximately 2500° F.

Similarly, some embodiments of the present technology can produce coke products using operations described in this disclosure having an FT that is within a specified range, such as an FT between 2250° F. and 2600° F. Some embodiments can implement operations that satisfy a stricter range for an FT, such as modifying operations to produce coke products having an FT between 2250° F. and 2400° F. Furthermore, some embodiments of the present technology can change coal blends, soak times, or durations at different damper positions to satisfy a target FT. For example, some embodiments of the present technology can select a coal blend or determine oven operations based on a target FT value of approximately 2250° F., approximately 2300° F., approximately 2350° F., approximately 2400° F., approximately 2450° F., approximately 2500° F., approximately 2550° F., or approximately 2600° F.

Some embodiments can produce coke products that satisfy multiple target ranges for different types of AFT values. For example, some embodiments of the present technology can include a coke product having an IDT between 2100° F. and 2250° F., an ST between 2150° F. and 2300° F., an HT between 2200° F. and 2350° F., or an FT between 2250° F. and 2400° F. Alternatively, or additionally, various other combination of target ranges for a coke product are possible.

For example, some embodiments of the present technology can include a coke product having an IDT between 2100° F. and 2250° F., an ST between 2150° F. and 2300° F., an HT between 2200° F. and 2350° F., and an FT between 2250° F. and 2400° F.

Some embodiments can generate coke products having AFTs that are within various composition boundaries to satisfy an AFT value. For example, some embodiments produce coke products having an AFT that is greater than 2300° F. or less than 2600° F. Some embodiments can include stricter tolerances for the production or selection of coke products for downstream use, such as being between 1800° F. and 2600° F., between 2200° F. and 2500° F., between 2300° F. and 2400° F., between 2400° F. and 2600° F., or between 2500° F. and 2600° F.

Some embodiments can use operations described in this disclosure to produce a coke product characterized by specific types of AFT values. For example, some embodiments of the present technology can produce a coke product having an AFT ST between 982° C. (1800° F.) and 1427° C. (2600° F.), 1177° C. (2150° F.) and 1371° C. (2500° F.) or a coke product having an AFT HT between 1204° C. (2200° F.) and 1371° C. (2500° F.), or an AFT flow temperature (FT) between 1232° C. (2250° F.) and 1371° C. (2500° F.).

As shown in the table 450, the CRI value of the foundry coke products can be 36.5% or another value that is greater than 35%. Some embodiments can implement coke production operations that produce batches of foundry coke that satisfy one or more CRI thresholds. For example, some embodiments of the present technology can change durations between changes in damper configurations or select between different damper positions based on a CRI threshold. For example, some embodiments of the present technology can produce foundry having a CRI that is at least 25.0%, at least 30.0%, at least 35.0%, at least 40.0%, at least 45.0%, or another value that is at least 30.0%. Some embodiments can perform operations to select coke products that have CRI greater than a minimum CRI threshold for downstream use. In some embodiments, a CRI for a coke product may indicate a mass loss from a reaction, where a greater CRI for a coke product may indicate a greater efficiency or usefulness of the coke product. In some embodiments, the CRI may be computed using a model based on known properties of a coke product or the coal blend used to generate the coke product. Alternatively, or additionally, a CRI may be experimentally obtained as a measured weight loss using an established testing protocol. For example, some embodiments may use a CRI-measuring method such as the ASTM method D5341 to determine a CRI value.

As shown in the table 450, the CSR value of the foundry coke products can be 26%, 15.6%, or another value that is greater than a CSR threshold such as 7.0%. Some embodiments can implement coke production operations that produce batches of foundry coke that satisfy one or more CSR thresholds. For example, some embodiments of the present technology can change durations between changes in damper configurations or select between different damper positions based on satisfying a target CSR threshold, such as a CSR threshold requiring that foundry coke have a CSR that is less than or equal to 40.0%, less than or equal to 35.0%, less than or equal to 30.0%, less than or equal to 25.0%, less than or equal to 20.0%, less than or equal to 15.0%, less than or equal to 10.0%, or less than or equal to 7.0%.

As shown in the table 450, an $SiO_2$ composition in coke product ash can include 49.4%, 48.9%, 48.8%, 49.1%, or 46.0%. Other embodiments can include other $SiO_2$ mass fractions in ash, such as other values less than 70%, less than 50.0%, less than 45.0%, etc. In some embodiments, a mass fraction of approximately 50.0% $SiO_2$ in coke product ash can correspond with a low amount of $SiO_2$ in the coke product itself.

Furthermore, some embodiments of the present technology can generate coke products having a fixed carbon content (e.g., a fixed carbon mass fraction) that is greater than or equal to a fixed carbon threshold. For example, some embodiments of the present technology can produce foundry coke products having a fixed carbon mass fraction that is greater than 80.0%, 85.0%, 90.0%, 90.5%, 91.0%, or some other value. In some embodiments, the fixed carbon content can be a targeted range. For example, some embodiments of the present technology can perform a set of operations to generate coke products having a fixed carbon content that is less than or equal to 94.5% but greater than or equal to 85.0% (though other ranges of values as possible, such as between 94.5% and 85.0%. Various other target ranges are possible, such as coke products having a range between 90.0% and 95.0%, 85% and 99%, etc.

Furthermore, some embodiments of the present technology can generate coke products having an ash mass fraction within a targeted bounded or unbounded range. For example, some embodiments of the present technology can produce foundry coke products having an ash mass fraction that is greater than or equal to 1.0%, 5.0%, 8.0%, 9.0%, 10.0%, or a value greater than 10.0%. Furthermore, some embodiments of the present technology can include an upper bound to an ash mass fraction. For example, some embodiments of the present technology can produce foundry coke products having an ash mass fraction that is less than 1.0%, 5.0%, 9.0%, 10.0%, or a value greater than 10.0%. Some embodiments can combine these upper and lower limits of ash mass fractions such that a produced coke product has a range of 5.0% to 10.0%, 8.5% to 9.0%, 8.0% to 10.0%, 5.0% to 15.0%, etc.

Figure 5:
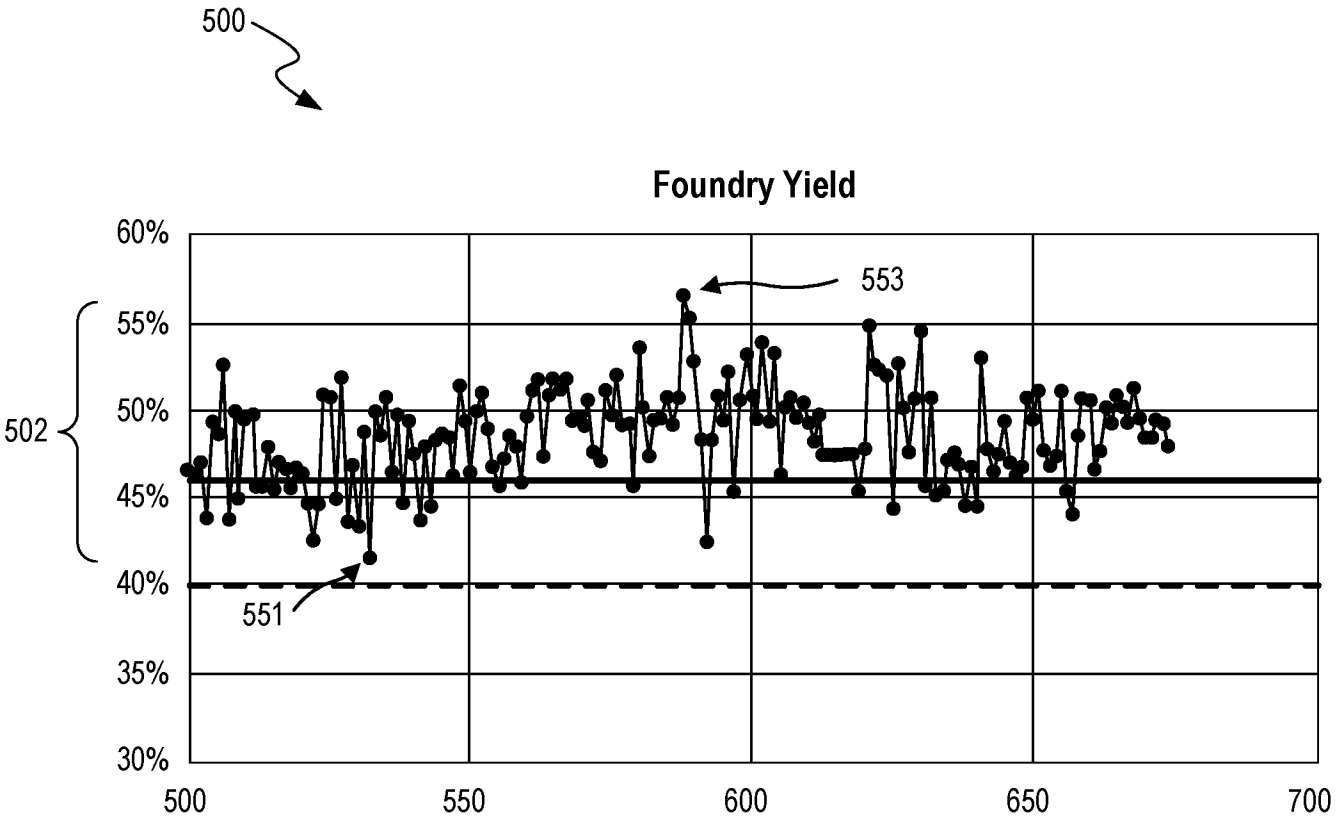
FIG. 5 is a chart indicating foundry coke product yield in accordance with one or more embodiments of the present technology.

FIG. 5 is a chart indicating foundry coke product yield in accordance with one or more embodiments of the present technology. As shown in the chart 500, the foundry yield for different batches of coke products produced from a coal blend using operations described in this disclosure can vary. As shown by the range 502, the yield can range between approximately 40% and 60% in some embodiments, where this yield can be a dry yield (i.e., the dry mass fraction of foundry coke product can be 40% or 60% of the dry mass fraction of the total population of coke products). As shown by the data point 553, some embodiments perform operations that result in a yield that is approximately 57%, though the yield can be lower in other cases. For example, as shown by the data point 551, the yield in some coke production operations can be lower, such as being as low as 41%. In many cases, some embodiments of the present technology can implement operations that satisfy a minimum yield threshold, such as operations that result in a yield that is at least 25%, at least 30%, at least 40%, at least 50%, at least 60%, etc. While some embodiments of the present technology can implement controller optimization operations to increase a yield, some embodiments of the present technology can permit a predicted yield to be less than an expected maximum yield in order to satisfy other target coke product parameters.

Figure 6:
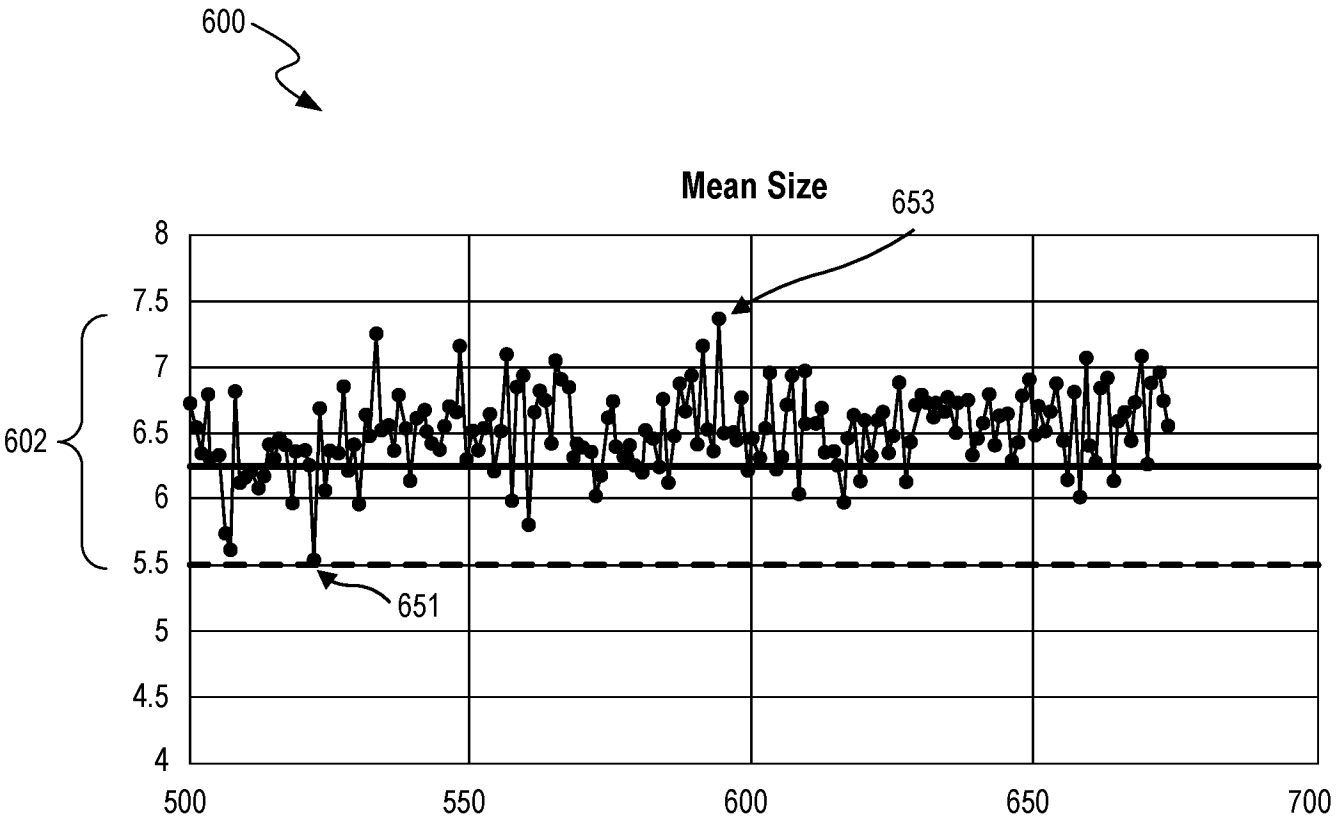
FIG. 6 is a chart indicating particle size, in accordance with one or more embodiments of the present technology.

FIG. 6 is a chart indicating particle size, in accordance with one or more embodiments of the present technology. As shown in the chart 600, the mean batch lengths in inches for different batches of coke products produced from a coal blend using operations described in this disclosure can vary.

As shown by a range 602, the coke product mean length can range between approximately 5.5 inches to approximately 7.5 inches in some embodiments. As shown by a data point 653, some embodiments perform operations that result in a coke product mean length that is approximately 7.4 inches, though the coke product mean length can be lower in other cases. For example, as shown by a data point 651, the coke product mean length in some coke production operations can be lower, such as being as low as 5.5 inches. In many cases, some embodiments of the present technology can implement operations that satisfy a minimum coke product mean length threshold, such as operations that result in a coke product mean length that is at least 2.5 inches, 4.0 inches, 5.0 inches, 6.0 inches, 7.0 inches, 8.0 inches, 9.0 inches, or some other length. In some embodiments, a larger coke product can result in more efficient foundry operations as a result. While some embodiments of the present technology can implement controller optimization operations to increase a coke product mean length, some embodiments of the present technology can permit a predicted coke product mean length to be less than an expected maximum coke product mean length in order to satisfy other target coke product parameters.

Figure 7:
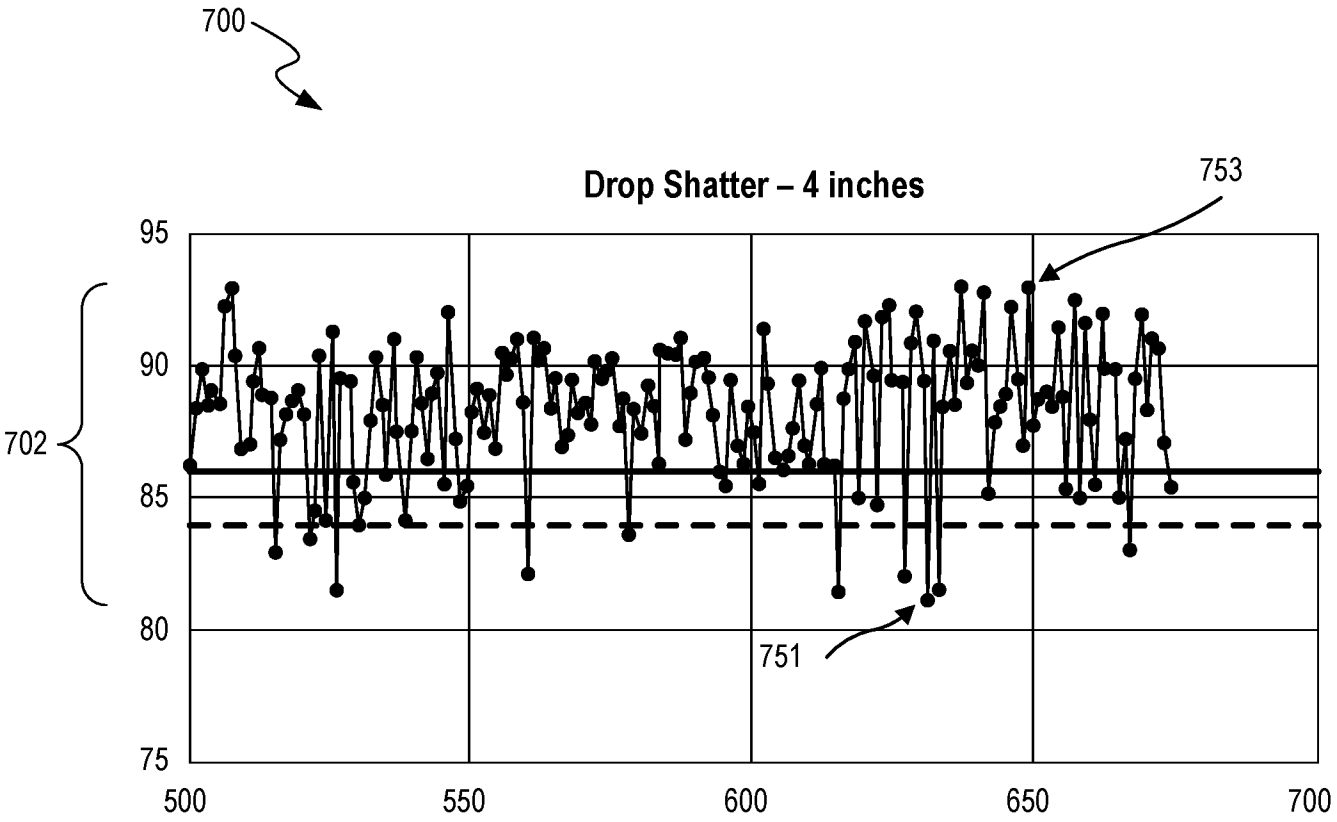
FIG. 7 is a chart indicating 4-inch drop shatter properties, in accordance with one or more embodiments of the present technology.

FIG. 7 is a chart indicating 4-inch drop shatter properties, in accordance with one or more embodiments of the present technology. As shown in the chart 700, the 4-inch drop shatter survival rates for different batches of coke products produced from a coal blend using operations described in this disclosure can vary. As shown by a range 702, the 4-inch drop shatter survival rate can range between approximately 80% to approximately 95% in some embodiments. As shown by a data point 753, some embodiments perform operations that result in a 4-inch drop shatter survival rate that is approximately 93%, though the 4-inch drop shatter survival rate can be lower in other cases. For example, as shown by a data point 751, the 4-inch drop shatter survival rate in some coke production operations can be lower, such as being as low as 81%. In many cases, some embodiments of the present technology can implement operations that satisfy a minimum 4-inch drop shatter survival rate threshold, such as operations that result in a 4-inch drop shatter survival rate that is at least 80%, at least 85%, at least 90%, or at least 95%, or at least some other 4-inch drop shatter threshold. In many cases, a greater drop shatter survival rate is useful for downstream foundry operations because more coke products survive transportation and downstream processing.

Figure 8:
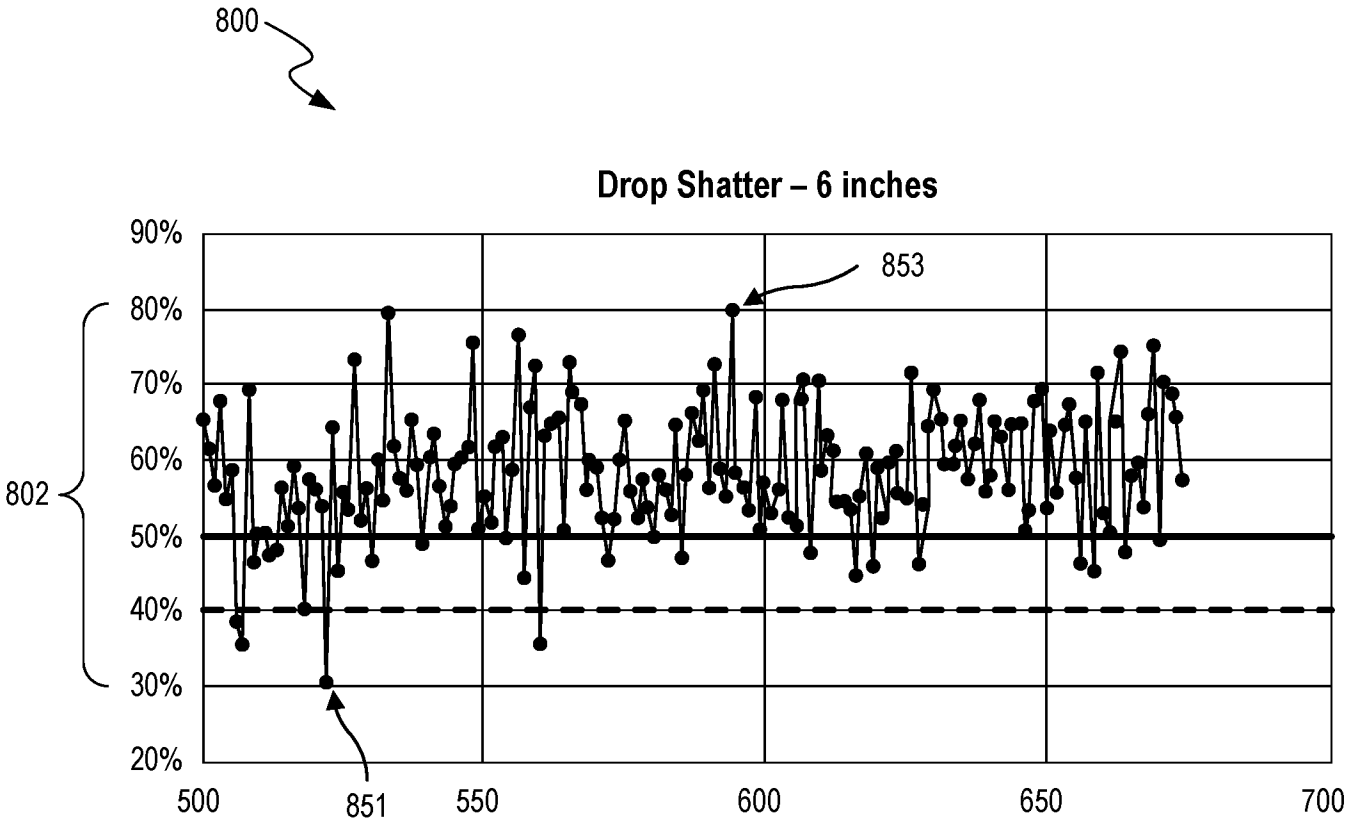
FIG. 8 is a chart indicating 6-inch drop shatter properties, in accordance with one or more embodiments of the present technology.

FIG. 8 is a chart indicating 6-inch drop shatter properties, in accordance with one or more embodiments of the present technology. As shown in the chart 800, the 6-inch drop shatter survival rates for different batches of coke products produced from a coal blend using operations described in this disclosure can vary. As shown by a range 802, the 6-inch drop shatter survival rate can range between approximately 30% to approximately 80% in some embodiments. As shown by a data point 853, some embodiments perform operations that result in a 6-inch drop shatter survival rate that is approximately 80%, though the 6-inch drop shatter survival rate can be lower in other cases. For example, as shown by a data point 851, the 6-inch drop shatter survival rate in some coke production operations can be lower, such as being as low as 30%. In many cases, some embodiments of the present technology can implement operations that satisfy a minimum 6-inch drop shatter survival rate threshold, such as operations that result in a 6-inch drop shatter survival rate that is at least 60%, at least 70%, at least 80%, or at least some other 6-inch drop shatter threshold, where the 6-inch drop shatter threshold can be less than a 4-inch drop shatter threshold.

Figure 9:
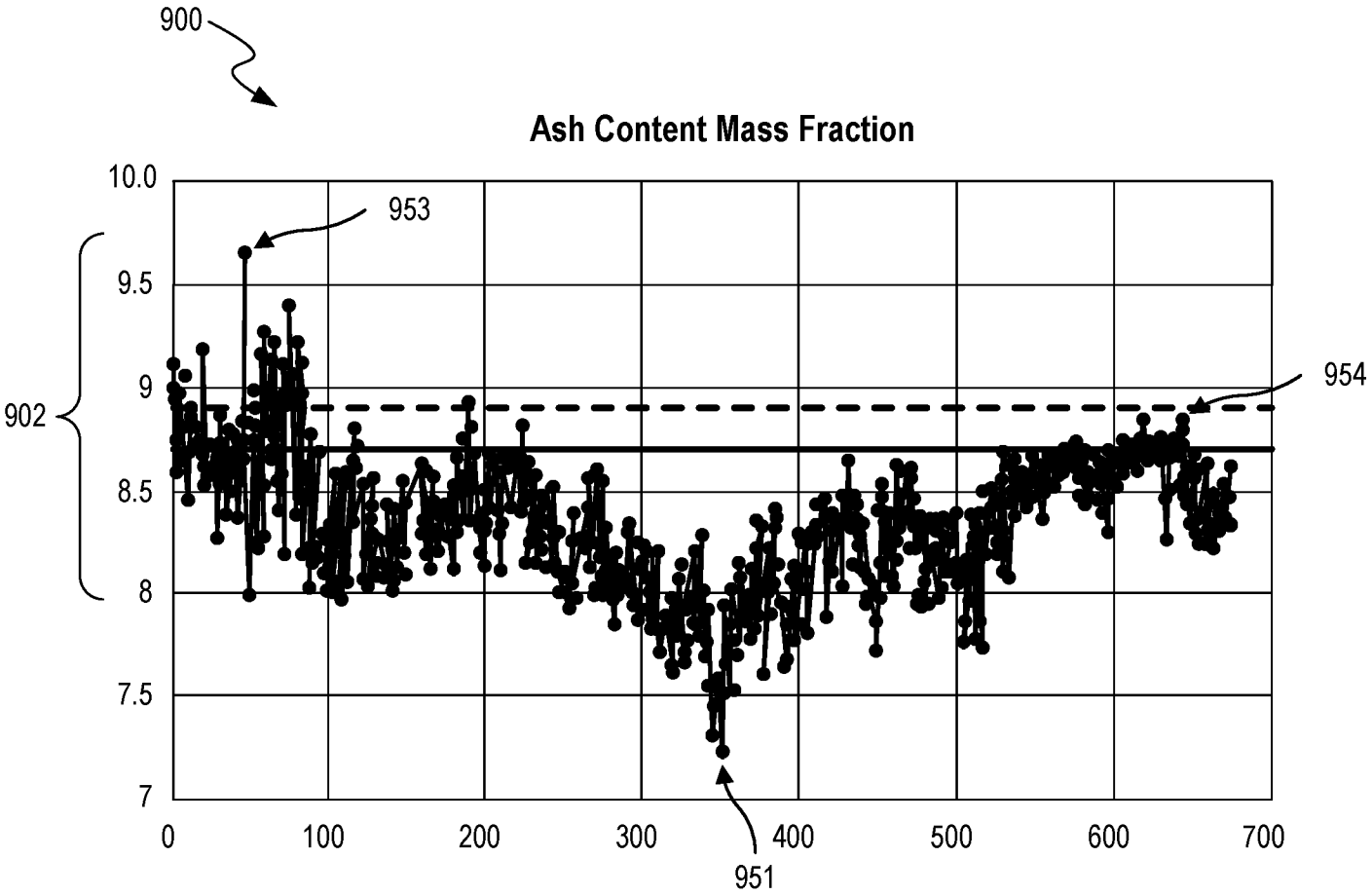
FIG. 9 is a chart indicating an ash mass fraction, in accordance with one or more embodiments of the present technology.

FIG. 9 is a chart indicating an ash mass fraction, in accordance with one or more embodiments of the present technology. As shown in the chart 900, the ash mass fractions for different batches of coke products produced from a coal blend using operations described in this disclosure can vary. As shown by a range 902, the ash mass fraction can range between approximately 7% to approximately 10% in some embodiments. As shown by a data point 953, some embodiments perform operations that result in an ash mass fraction that is approximately 9.7%, though the ash mass fraction can be lower in other cases. For example, as shown by a data point 954, the ash mass fraction in some coke production operations can be 8.8%. Additionally, or alternatively, as shown by the data point 951, the ash mass fraction in some coke production operations can be lower, such as being as low as 7.2%.

In some embodiments, an ash content of a coke product produced using operations described in this disclosure can be less than an ash mass fraction threshold, where the ash mass fraction threshold can be 10.0%, 9.0%, 8.5%, 8.0%, 7.5%, or another value less than 50.0%. In some embodiments, the ash mass fraction can be unconventionally high, such as greater than 10.0%. Alternatively, or additionally, some embodiments of the present technology can produce a coke product having an ash mass fraction threshold that satisfies an ash mass fraction threshold that is less than 10.0%, less than 9.0%, less than 8.5%, less than 8.0%, less than 7.5%, or less than 7.0%. Some embodiments can include ash within a range, such as between 5.5% and 7.0%, 6.0% and 6.5%, between 8.0% and 10.0%, or between some other values. Furthermore, some embodiments of the present technology can produce a set of coke products that satisfies a target mass fraction value. For example, some embodiments of the present technology can produce a coke product having an ash mass fraction that satisfies a target ash mass fraction, where the target ash mass fraction can be approximately 9.0%, approximately 8.5%, approximately 8.0%, approximately 7.5%, or approximately 7.0%.

In some embodiments, some embodiments of the present technology can implement operations that produce coke products which satisfies a minimum ash mass fraction threshold, such as coke products having an ash mass fraction that is at least 7.0%, at least 8.0%, at least 9.0%, or at least some other ash mass fraction. Furthermore, some embodiments of the present technology can determine coal blend formulations or perform coke oven operations that have an ash mass fraction that is within a pre-defined range, such as between 7.0% and 10.0%.

Figure 10:
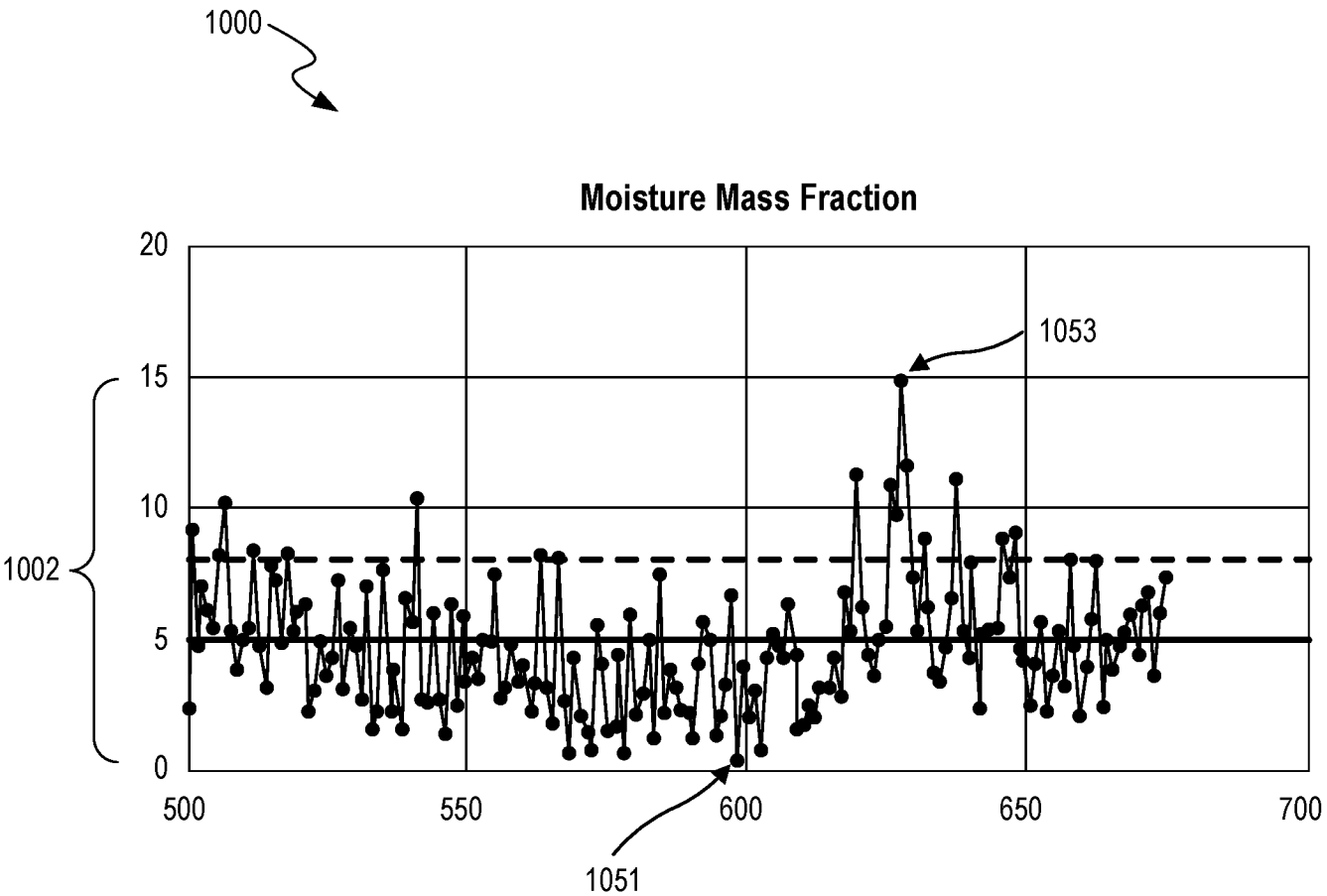
FIG. 10 is a chart indicating a moisture mass fraction, in accordance with one or more embodiments of the present technology.

FIG. 10 is a chart 1000 indicating a moisture mass fraction, in accordance with one or more embodiments of the present technology. As shown in the chart 1000, the coke product moisture mass fractions for different batches of coke products produced from a coal blend using operations described in this disclosure can vary. As shown by a range 1002, the coke product moisture mass fractions can range between approximately 0% to approximately 15% in some embodiments. As shown by the data point 1053, some embodiments perform operations that result in a coke product moisture mass fraction that is approximately 15%, though the coke product moisture mass fraction can be lower in other cases. Additionally, as shown by the data point 1051, the coke product moisture mass fraction in some coke production operations can be lower, such as being as low as 0.5%. In many cases, some embodiments of the present technology can implement operations that satisfy a minimum coke product moisture mass fraction threshold, such as operations that result in a coke product moisture mass fraction that is at least 7.0%, at least 8.0%, at least 9.0%, or at least some other coke product moisture mass fraction. Furthermore, some embodiments of the present technology can determine coal blend formulations or perform coke oven operations that have a coke product moisture mass fraction that is within a pre-defined range, such as between 7.0% and 10.0%. Furthermore, some embodiments of the present technology can determine coal blend formulations or perform coke oven operations that have a coke product moisture mass fraction that is less than a pre-defined value, such as less than or equal to 10.0%, less or equal to 8.0%, less than or equal 7.0%, less than or equal to 5.0%, etc.

Figure 11:
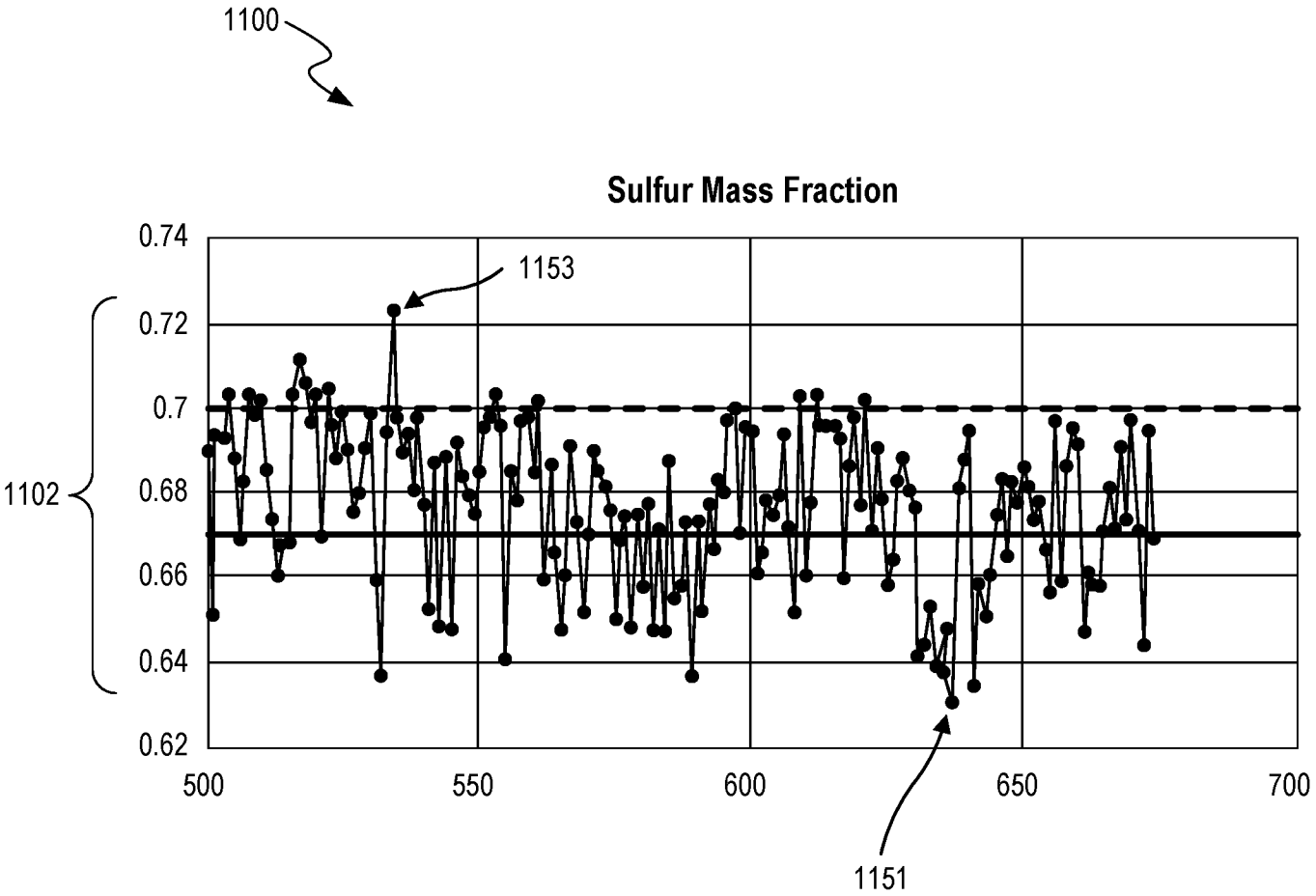
FIG. 11 is a chart indicating a sulfur mass fraction, in accordance with one or more embodiments of the present technology.

FIG. 11 is a chart 1100 indicating a sulfur mass fraction, in accordance with one or more embodiments of the present technology. As shown in the chart 1100, the sulfur mass fractions for different batches of coke products produced from a coal blend using operations described in this disclosure can vary. As shown by a range 1102, the sulfur mass fractions can range between approximately 0.60% to approximately 0.75% in some embodiments. As shown by a data point 1153, some embodiments perform operations that result in a sulfur mass fraction that is approximately 0.73%, though the sulfur mass fraction can be lower in other cases. Additionally, as shown by the data point 1151, the sulfur mass fraction in some coke production operations can be lower, such as being as low as 0.63%.

In some embodiments, the sulfur content of the coke product can be less than a sulfur mass fraction threshold. For example, the sulfur content of a coke product can be less than 1.0%, less than 0.9%, less than 0.8%, less than 0.7%, less than 0.6%, less than 0.5%, less than 0.3%, less than 0.2%, or less than 0.1%. Some embodiments determine the formulation of a coal blend, determine a soak time, or determine a damper control schedule to reduce the amount of sulfur in a coke product. Furthermore, a coke product can be produced based on a target sulfur content value, such as a target sulfur mass fraction of 0.65%. As described elsewhere, by reducing the sulfur content of coke products, some embodiments of the present technology can enhance the efficiency of foundry operations.

Figure 12:
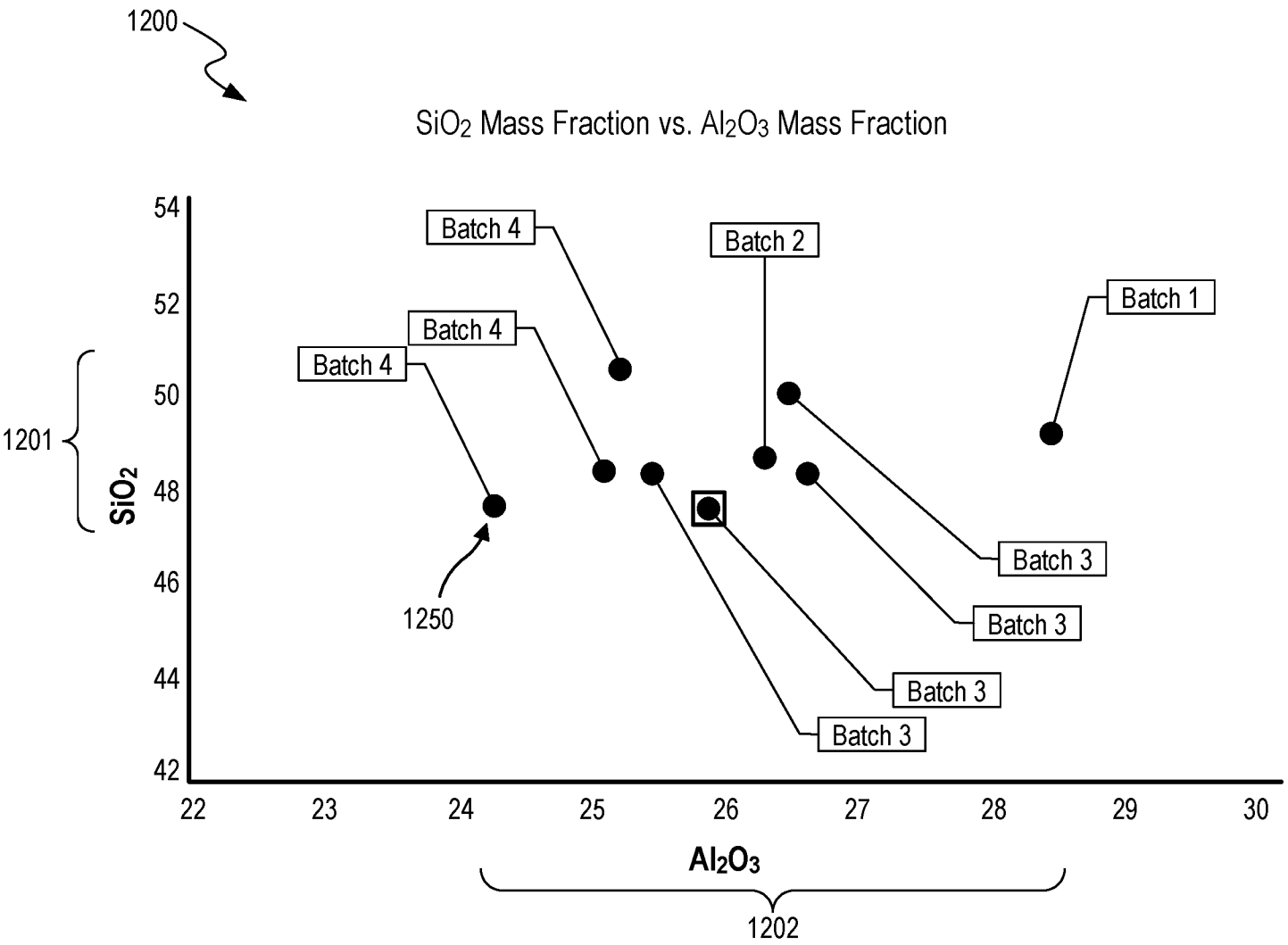
FIG. 12 is a chart depicting $SiO_2$ mass fractions vs. $Al_2O_3$ mass fractions in the ash of foundry coke products, in accordance with one or more embodiments of the present technology.

FIG. 12 is a chart 1200 depicting $SiO_2$ mass fractions vs. Al2O3 mass fractions in the ash of foundry coke products, in accordance with one or more embodiments of the present technology. In some embodiments, a coke product can be characterized based on their mass fractions of $SiO_2$ and $Al_2O_3$ or ratios of these mass fractions. As shown in the chart 1200, different samples of coke ash can indicate different mass fractions or mass fraction ratios of $SiO_2$ and $Al_2O_3$. For example, the point 1250 indicates a sample having an $SiO_2$ mass fraction of approximately 48.0% and an $Al_2O_3$ mass fraction of approximately 24.3%, which suggests that some ash of coke products can have a ratio of approximately 2:1 for a mass fraction ratio of $SiO_2$ to $Al_2O_3$. As indicated by the range 1201, the $SiO_2$ mass fractions of different samples can range between 48.0% and 51.0% in some embodiments. Furthermore, as indicated by the range 1202, the $SiO_2$ mass fractions of different samples can range between 24.3% and 28.4% in some embodiments.

Some embodiments can produce a coke product that minimizes the combination of $Al_2O_3$ and $SiO_2$ or has a low amount of $Al_2O_3$ and $SiO_2$. For example, some embodiments of the present technology can perform operations that produce coke products such that the ash of the coke products have a combined $Al_2O_3$ mass fraction and $SiO_2$ mass fraction of that is less than or equal to 65%. By reducing the amount of Al and Si in a coke product, some embodiments of the present technology can increase the efficiency of foundry operations by reducing their interference with carbon dissolution during foundry operations.

Some embodiments can produce a coke product or a coal blend used to produce the coal blend that satisfy other thresholds for $Al_2O_3$ or $SiO_2$. For example, some embodiments of the present technology can produce a coke product such that an $Al_2O_3$ mass fraction of the ash of the coke product, or an ash of a coal blend used to create the coke product, is less than or approximately 30%, less than or approximately 25%, or less than or approximately 20%. Alternatively, or additionally, some embodiments of the present technology can produce a coke product such that an $SiO_2$ mass fraction of the ash of the coke product or an ash of a coal blend used to create the coke product is less than or approximately 50%, less than or approximately 45%, less than or approximately 40%, or less than or approximately 35%.

Alternatively or additionally, some embodiments of the present technology can produce a coke product such that a sum of a $SiO_2$ mass fraction and $Al_2O_3$ mass fraction of an ash of the coke product or an ash of a coal blend used to create the coke product is less than or approximately 80%, less than or approximately 75%, less than or approximately 70%, less than or approximately 65%.

Figure 13:
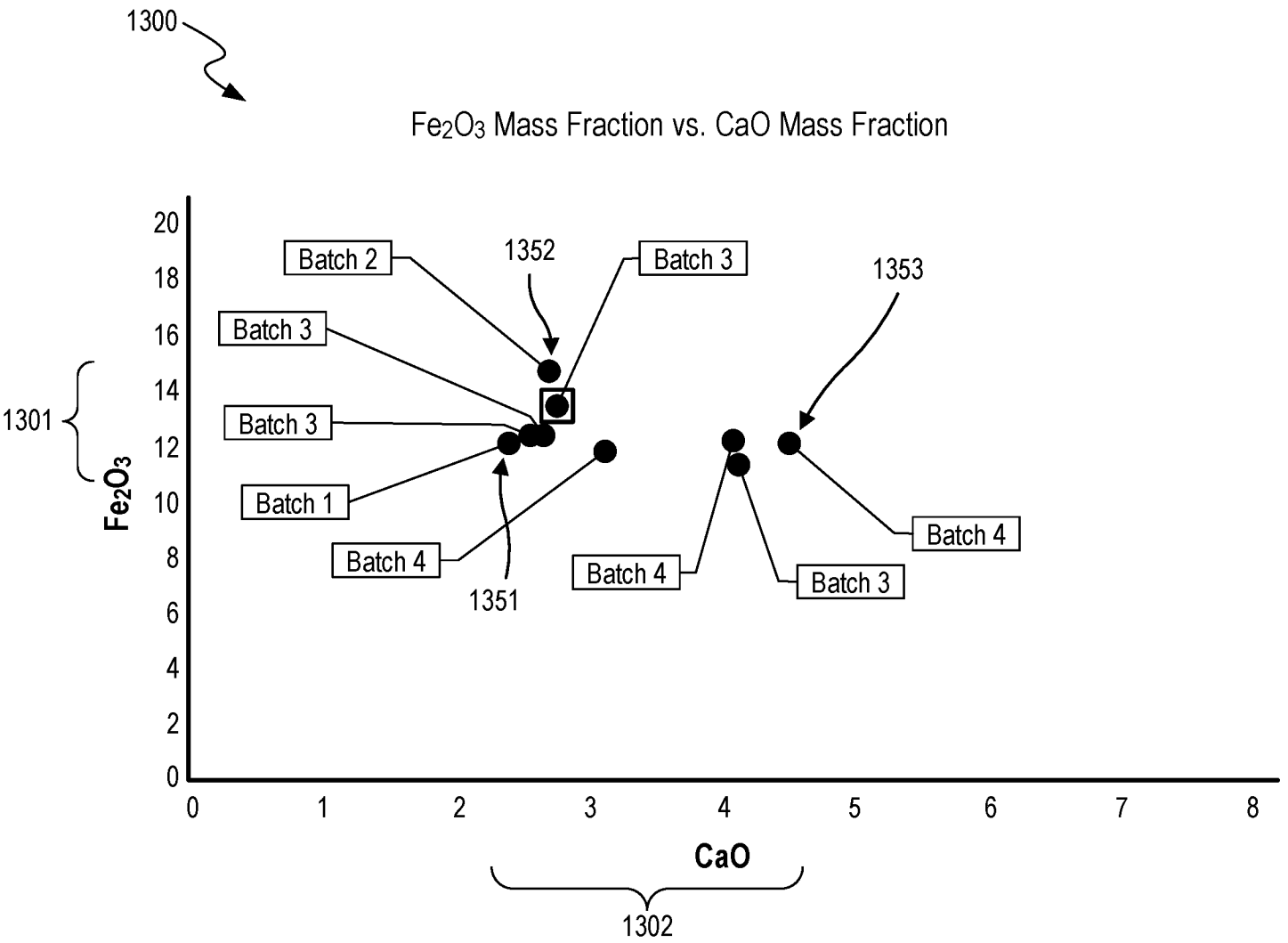
FIG. 13 is a chart depicting $Fe_2O_3$ mass fractions vs. CaO mass fractions in the ash of foundry coke products, in accordance with one or more embodiments of the present technology.

FIG. 13 is a chart 1300 depicting Fe2O3 mass fractions vs. CaO mass fractions in the ash of foundry coke products, in accordance with one or more embodiments of the present technology. In some embodiments, a coke product can be characterized based on their mass fractions of $Fe_2O_3$ and CaO or ratios of these mass fractions. As shown in the chart 1300, different data points representing coke ash samples can indicate different mass fractions and mass fraction ratios of $Fe_2O_3$ and CaO. For example, the point 1351 indicates a sample having an $Fe_2O_3$ mass fraction of approximately 12.1% and an CaO mass fraction of approximately 2.4%. Furthermore, the point 1352 indicates a sample having an $Fe_2O_3$ mass fraction of approximately 15.0% and an CaO mass fraction of approximately 2.8%. Furthermore, the point 1352 indicates a sample having an $Fe_2O_3$ mass fraction of approximately 12.0% and an CaO mass fraction of approximately 4.5%. Collectively, the points 1351 indicate that the mass fraction ratios of $Fe_2O_3$ and CaO for some samples can range between being approximately 5:1 to approximately 5:2 in some embodiments. Furthermore, as indicated by the range 1301, the $Fe_2O_3$ mass fractions of different samples can range between 11.0% and 15.0% in some embodiments. Furthermore, as indicated by the range 1302, the $Fe_2O_3$ mass fractions of CaO can range between 2.5% and 4.5% in some embodiments.

Some embodiments can produce a coke product using operations to increase the amount of CaO in a coke product. For example, some embodiments of the present technology can perform operations that produce coke products such that the ash of the coke products have a CaO mass fraction that is greater than or equal to 3.0%. Alternatively, or additionally, other maximum CaO thresholds can be used. For example, some embodiments of the present technology can produce coke products such that the ash of the coke products have a CaO mass fraction that is greater than or equal to 10.0%, greater than or equal to 9.0%, greater than or equal to 8.0%, greater than or equal to 7.0%, greater than or equal to 6.0%, greater than or equal to 5.0%, greater than or equal to 4.0%, greater than or equal to 3.0%, greater than or equal to 2.0%, greater than or equal to 1.0%, etc. Some embodiments can create a coke product from a coal blend having a high content of CaO, where this content can be determined by an ash composition. Such a high content of CaO can increase a carbon dissolution rate of the coke product.

Figure 14:
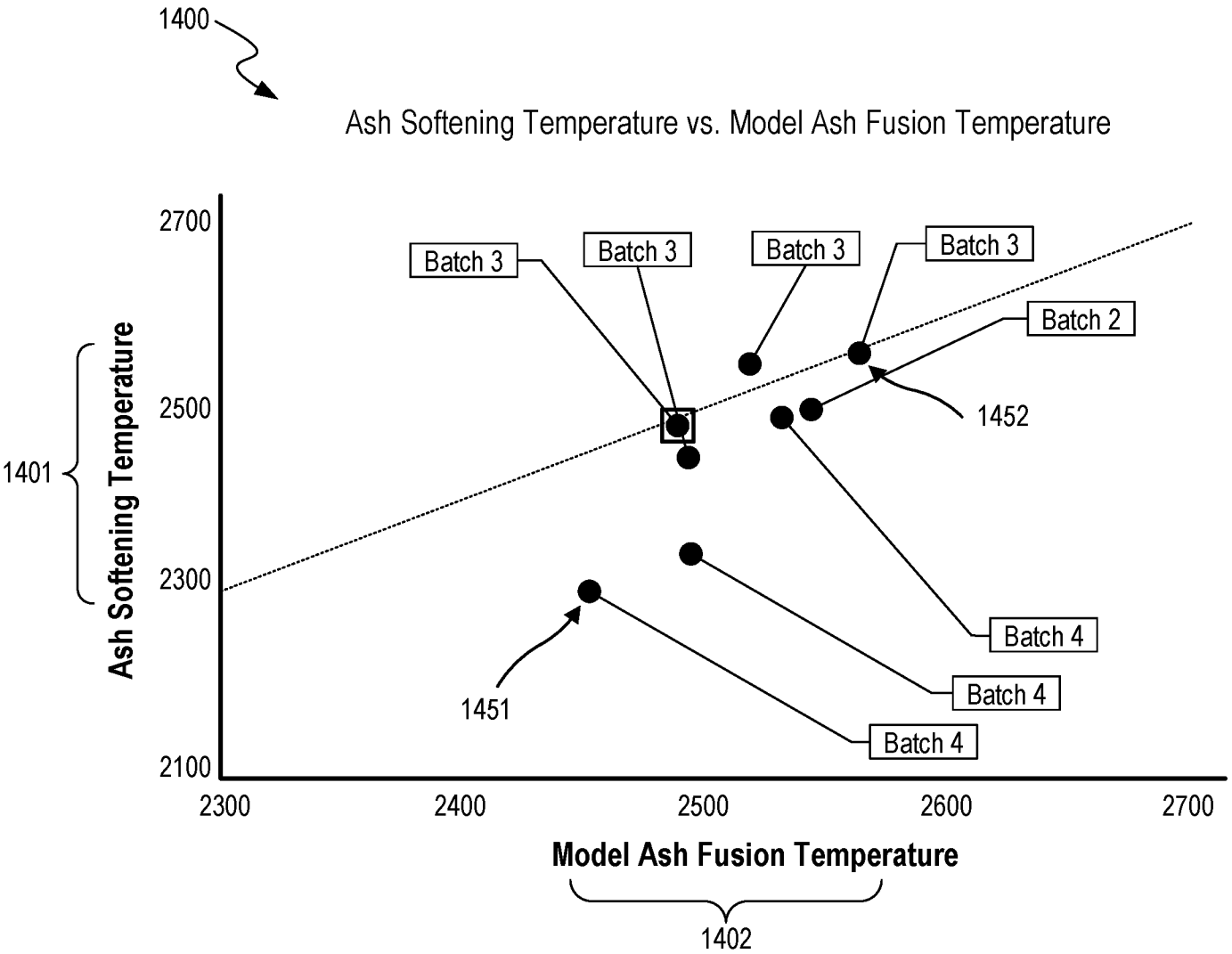
FIG. 14 is a chart depicting Ash Softening Temperatures vs. Model Ash Fusion Temperatures of different batches of foundry coke products, in accordance with one or more embodiments of the present technology.

FIG. 14 is a chart 1400 depicting Ash Softening Temperatures vs. Model Ash Fusion Temperatures of different batches of foundry coke products, in accordance with one or more embodiments of the present technology. In some embodiments, a coke product can be characterized based on their ash ST values, model AFT values, or ratios of these two values. As shown in the chart 1400, different samples of coke ash can have different ST and model AFT values. For example, the point 1451 indicates a sample having an ash ST value equal t24o approximately 2300° F. and a model AFT value equal to approximately 2450° F. Furthermore, the point 1452 indicates a sample having an ash ST value equal to approximately 2550° F. and a model AFT value equal to approximately 2580° F. Furthermore, as indicated by a range 1401, the ash ST value of different samples can range between 2300° F. and 2600° F. in some embodiments. Furthermore, as indicated by a range 1402, the model AFT values of some samples can range between 2450° F. and 2600° F. in some embodiments.

Figure 15:
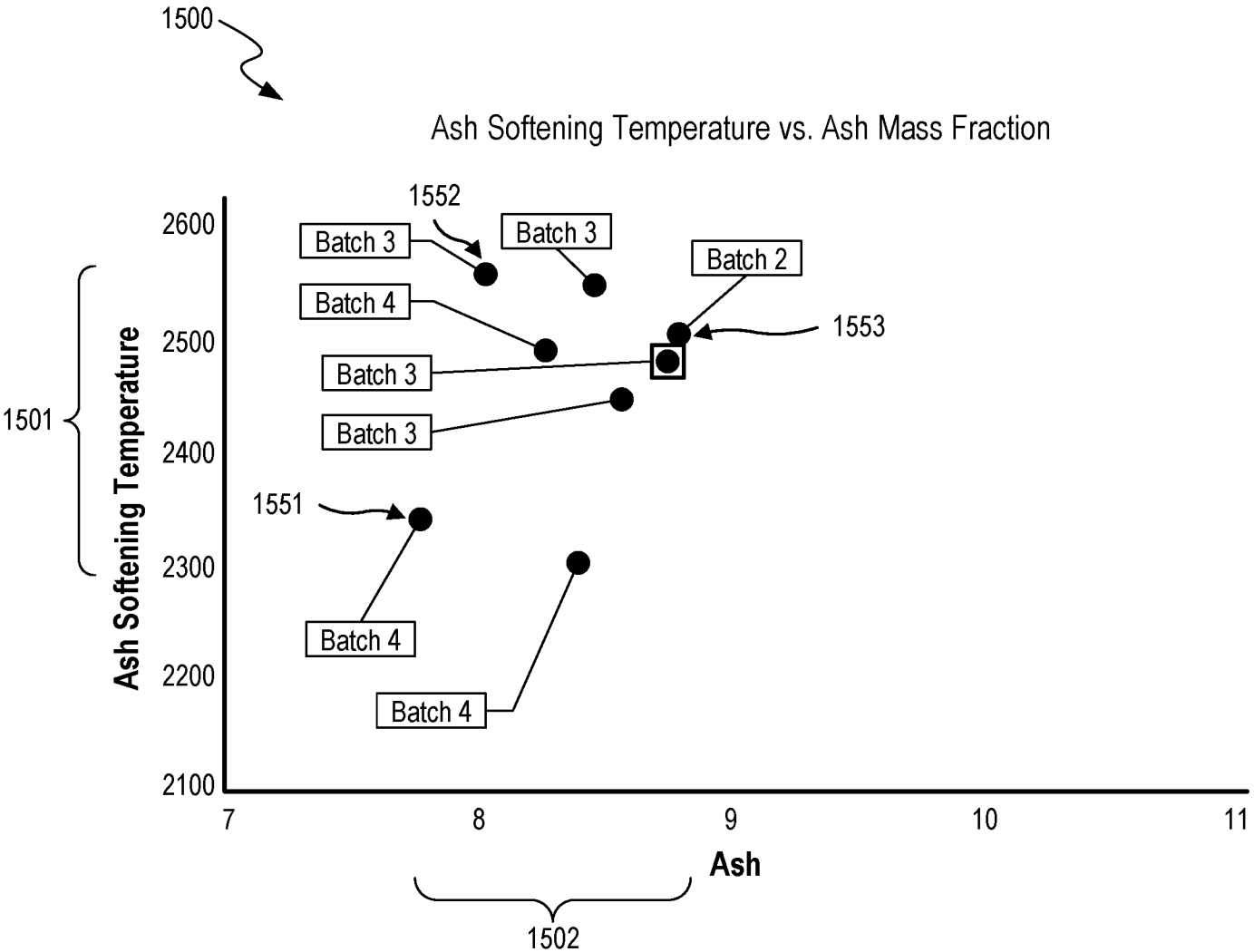
FIG. 15 is a chart depicting Ash Softening Temperatures vs. Ash Mass Fractions of different batches of foundry coke products, in accordance with one or more embodiments of the present technology.

FIG. 15 is a chart 1500 depicting Ash Softening Temperatures vs. Ash Mass Fractions of different batches of foundry coke products, in accordance with one or more embodiments of the present technology. In some embodiments, a coke product can be characterized based on their ash mass fractions or observed ash ST values. As shown in the chart 1500, different samples of coke ash can indicate different ash mass fractions and observed STs for the different ash samples. For example, the point 1551 indicates a sample having an ST value equal to approximately 2350° F. and an ash mass fraction of approximately 7.8%. Furthermore, the point 1352 indicates a sample having an ST value equal to approximately 2560° F. and an ash mass fraction of approximately 8.1%. Furthermore, the point 1353 indicates a sample having an ST value equal to approximately 2500° F. and an ash mass fraction of approximately 8.8%. Some embodiments can produce coke products having lower ash content and lower AFT than coke products using conventional coal blends or conventional operations. By reducing the ash of a coke product available to build up at a coke surface, some embodiments of the present technology can thus improve a carbon dissolution rate during a foundry operation. Similarly, by reducing an ash fusion temperature of a coke product, some embodiments of the present technology can improve an ash dissolution rate by reducing the temperature required to ash from a coke surface during a foundry operation.

In some embodiments, as indicated by the range 1501, the ash content values of different samples can range between 2300° F. and 2560° F. Furthermore, as indicated by the range 1502, the ash content can range between approximately 7.8% to 8.8%. As shown in the chart 1500, some embodiments of the present technology can produce a coke product having an ash mass fraction that is less than 10.0%, less than 9.0%, or less than another maximum ash mass fraction threshold. Furthermore, some embodiments of the present technology can perform operations to maintain a minimum amount of ash product. For example, some embodiments of the present technology can implement coke oven operations to produce coke products having at least 1.0% ash, 5.0% ash, 7.0% ash, etc.

Figure 16:
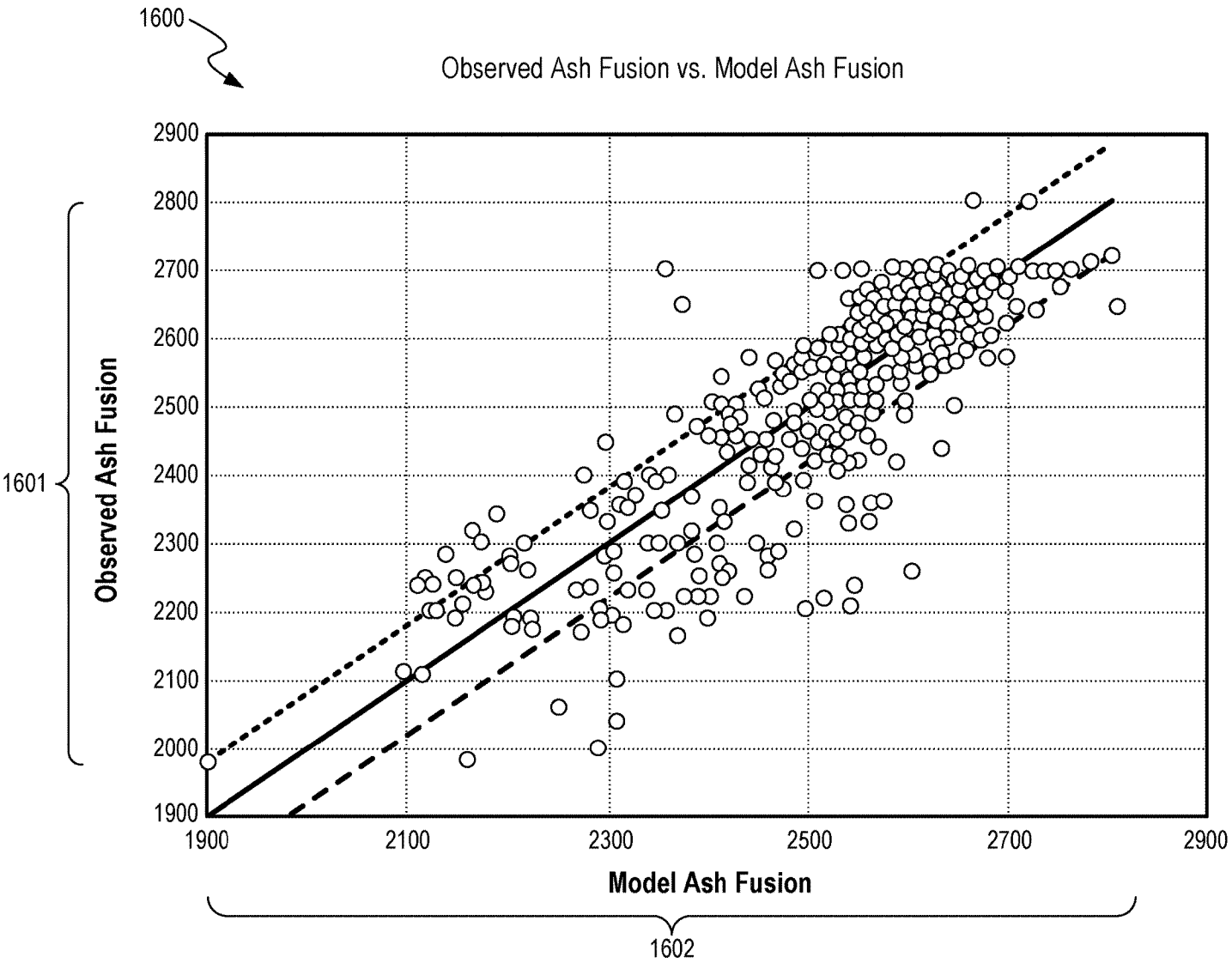
FIG. 16 is a chart depicting Observed Ash Fusion Temperatures vs. Model Ash Fusion Temperatures of different batches of foundry coke products, in accordance with one or more embodiments of the present technology.

FIG. 16 is a chart 1600 depicting Observed Ash Fusion Temperatures vs. Model Ash Fusion Temperatures of different batches of foundry coke products, in accordance with one or more embodiments of the present technology. The chart 1600 includes a first range 1601, which indicates the range of observed AFT values that range from approximately 1990° F. to approximately 2800° F. The chart 1600 includes a second range, which indicates the range of model AFT values that range between 1900° F. to 2750° F. As shown by the chart 1600, coke products can show an approximate direct correlation between model AFT values and observed AFT values.

From the foregoing, it will be appreciated that, although specific embodiments of the technology have been described herein for purposes of illustration, various modifications can be made without deviating from the spirit and scope of the technology. Further, certain aspects of the new technology described in the context of particular embodiments can be combined or eliminated in other embodiments. Moreover, while advantages associated with certain embodiments of the technology have been described in the context of those embodiments, other embodiments can also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

IV. Conclusion

It will be apparent to those having skill in the art that changes can be made to the details of the above-described embodiments without departing from the underlying principles of the present disclosure. In some cases, well known structures and functions have not been shown or described in detail to avoid unnecessarily obscuring the description of the embodiments of the present technology. Although steps of methods can be presented herein in a particular order, alternative embodiments can perform the steps in a different order. Similarly, certain aspects of the present technology disclosed in the context of particular embodiments can be combined or eliminated in other embodiments. Furthermore, while advantages associated with certain embodiments of the present technology can have been disclosed in the context of those embodiments, other embodiments can also exhibit such advantages, and not all embodiments need necessarily exhibit such advantages or other advantages disclosed herein to fall within the scope of the technology. Accordingly, the disclosure and associated technology can encompass other embodiments not expressly shown or described herein, and the invention is not limited except as by the appended claims.

Reference herein to "one embodiment," "an embodiment," "some embodiments," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics can be combined in any suitable manner in one or more embodiments.

Unless otherwise indicated, all numbers expressing weight percentages, concentrations, compositions, and other numerical values used in the specification and claims, are to be understood as being modified in all instances by the term "approximately." Accordingly, unless indicated to the contrary, the numerical parameters set forth in the following specification and attached claims are approximations that can vary depending upon the desired properties sought to be obtained by the present technology. As used in this disclosure, unless otherwise disclosed, a value can be considered to be approximately a target value if a difference between the value and the target value is less than or equal to 10% of the target value. At the very least, and not as an attempt to limit the application of the doctrine of equivalents to the scope of the claims, each numerical parameter should at least be construed in light of the number of reported significant digits and by applying ordinary rounding techniques. Additionally, all ranges disclosed herein are to be understood to encompass any and all subranges subsumed therein. For example, a range of "1 to 10" includes any and all subranges between (and including) the minimum value of 1 and the maximum value of 10 (i.e., any and all subranges having a minimum value of equal to or greater than 1 and a maximum value of equal to or less than 10, e.g., 5.5 to 10).

Although the present invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the scope of the appended claims. For example, it is to be understood that the present invention contemplates that, to the extent possible, one or more features of any embodiment can be combined with one or more features of any other embodiment.

As used throughout this application, the word "can" is used in a permissive sense (i.e., meaning having the potential to), rather than the mandatory sense (i.e., meaning must). The words "comprise," "comprising," "include," "including," "includes," and the like mean including, but not limited to. As used throughout this application, the singular forms "a," "an," and "the" include plural referents unless the context clearly indicates otherwise. Thus, for example, reference to "an element" or "an element" includes a combination of two or more elements, notwithstanding use of other terms and phrases for one or more elements, such as "one or more."

Various other aspects, features, and advantages will be apparent through the detailed description of this disclosure and the drawings attached hereto. It is also to be understood that the description of this disclosure are examples, and not restrictive of the scope of the invention. As used in the specification and in the claims, the singular forms of "a," "an," and "the" include plural referents unless the context clearly dictates otherwise. Additionally, as used in the specification, "a portion" refers to a part of, or the entirety (i.e., the entire portion), of a given item (e.g., data) unless the context clearly dictates otherwise. Furthermore, a "set" can refer to a singular form or a plural form, such that a "set of items" can refer to one item or a plurality of items.

The term "or" is non-exclusive (i.e., encompassing both "and" and "or"), unless the context clearly indicates otherwise. Terms describing conditional relationships (e.g., "in response to X, Y," "upon X, Y," "if X, Y," "when X, Y," and the like) encompass causal relationships in which the antecedent is a necessary causal condition, the antecedent is a sufficient causal condition, or the antecedent is a contributory causal condition of the consequent (e.g., "state X occurs upon condition Y obtaining" is generic to "X occurs solely upon Y" and "X occurs upon Y and Z"). Such conditional relationships are not limited to consequences that instantly follow the antecedent obtaining, as some consequences can be delayed, and in conditional statements, antecedents are connected to their consequents (e.g., the antecedent is relevant to the likelihood of the consequent occurring). Statements in which a plurality of attributes or functions are mapped to a plurality of objects (e.g., one or more processors performing steps/operations A, B, C, and D) encompass both all such attributes or functions being mapped to all such objects and subsets of the attributes or functions being mapped to subsets of the objects (e.g., both all processors each performing steps/operations A-D, and a case in which processor 1 performs step/operation A, processor 2 performs step/operation B and part of step/operation C, and processor 3 performs part of step/operation C and step/operation D), unless otherwise indicated. Further, unless otherwise indicated, statements that one value or action is "based on" another condition or value encompass both instances in which the condition or value is the sole factor and instances in which the condition or value is one factor among a plurality of factors.

Unless the context clearly indicates otherwise, statements that "each" instance of some collection have some property should not be read to exclude cases where some otherwise identical or similar members of a larger collection do not have the property (i.e., each does not necessarily mean each and every). Limitations as to sequence of recited steps should not be read into the claims unless explicitly specified (e.g., with explicit language like "after performing X, performing Y"), in contrast to statements that might be improperly argued to imply sequence limitations (e.g., "performing X on items, performing Y on the X'ed items") used for purposes of making claims more readable rather than specifying sequence. Statements referring to "at least Z of A, B, and C" and the like (e.g., "at least Z of A, B, or C") refer to at least Z of the listed categories (A, B, and C) and do not require at least Z units in each category. Unless the context clearly indicates otherwise, it is appreciated that throughout this specification discussions utilizing terms such as "processing," "computing," "calculating," "determining," or the like refer to actions or processes of a specific apparatus, such as a special purpose computer or a similar special purpose electronic processing/computing device.

The present technology is illustrated, for example, according to various aspects described below as numbered embodiments (1, 2, 3, etc.) for convenience. These are provided as examples and do not limit the present technology. It is noted that any of the dependent embodiments can be combined in any combination, and placed into a respective independent embodiment.

1. A coke product, comprising:

a Coke Reactivity Index (CRI) of at least 30%; and an ash fusion temperature (AFT) no more than 1316° C.

2. A coke product, comprising:

an ash having a composition that satisfies the following equation:

$$\text{Ash Fusion Temperature (AFT)}=19\times(Al_2O_3_mass_fraction)+15\times(SiO_2_mass_fraction+TiO_2_mass_fraction)+10\times(CaO_mass_fraction+MgO_mass_fraction)+6\times(Fe_2O_3_mass_fraction+Na_2O_mass_fraction),$$

wherein:

the AFT is a value between 1204° C. and 1426° C.;

the $SiO_2$_mass_fraction is an $SiO_2$ mass fraction of the ash;

the $Al_2O_3$_mass_fraction is an $Al_2O_3$ mass fraction of the ash;

the $Fe2O_3$_mass_fraction is an $Fe2O_3$ mass fraction of the ash;

the CaO_mass_fraction is a CaO mass fraction of the ash; and the MgO_mass_fraction is an MgO mass fraction of the ash.

3. A coke product, comprising:

an ash having a composition that satisfies the following equation:

$$\text{Ash Fusion Temperature (AFT)}=19\times(Al_2O_3_mass_fraction)+15\times(SiO_2_mass_fraction+TiO_2_mass_fraction)+10\times(CaO_mass_fraction+MgO_mass_fraction)+6\times(Fe2O_3_mass_fraction+Na_2O_mass_fraction+K_2O_mass_fraction),$$

wherein:

the AFT is a value between 982° C. ° C. and 1426° C.;

the $SiO_2$_mass_fraction is an $SiO_2$ mass fraction of the ash;

the $Al_2O_3$_mass_fraction is an $Al_2O_3$ mass fraction of the ash;

the $Fe2O_3$_mass_fraction is an $Fe2O_3$ mass fraction of the ash;

the CaO_mass_fraction is a CaO mass fraction of the ash;

the MgO_mass_fraction is an MgO mass fraction of the ash; and the $K_2O$_mass_fraction is an $K_2O$ mass fraction of the ash.

4. A coke product, comprising:

an ash having a composition that satisfies the following equation:

$$\text{Ash Fusion Temperature (AFT)}=401.5+26.3\times SiO_2_mass_fraction+40.7\times Al_2O_3_mass_fraction)-11.0\times Fe2O_3_Mass_Fraction-7.9\times CaO_mass_fraction-112\times MgO_mass_fraction),$$

wherein:

the AFT is a value between 982° C. and 1204° C.;

the $SiO_2$_mass_fraction is an $SiO_2$ mass fraction of the ash;

the $Al_2O_3$_mass_fraction is an $Al_2O_3$ mass fraction of the ash;

the $Fe2O_3$_mass_fraction is an $Fe2O_3$ mass fraction of the ash;

the CaO_mass_fraction is a CaO mass fraction of the ash;

the MgO_mass_fraction is an MgO mass fraction of the ash.

5. The coke product of any one of embodiments 1 to 4, wherein the AFT is approximately equal to at least one of 1204° C., 1260° C., 1288° C., 1316° C., 1343° C., 1371° C., 1399° C., or 1427° C.

6. The coke product of any one of embodiments 1 to 5, wherein the coke product has an initial deformation temperature between 1149° C. and 1316° C.

7. The coke product of any one of embodiments 1 to 6, wherein the coke product has a softening temperature between 1177° C. and 1371° C.

8. The coke product of any one of embodiments 1 to 7, wherein the coke product has a hemispherical temperature between 1204° C. and 1371° C.

9. The coke product of any one of embodiments 1 to 8, wherein the coke product has a fluid temperature between and 1232° C. and 1427° C.

10. The coke product of any one of embodiments 1 to 9, wherein a mass fraction of the ash of the coke product is no more than 10.0%.

11. The coke product of any one of embodiments 1 to 10, wherein a mass fraction of sulfur or sulfur oxide of the coke product is no more than 1.0%.

12. The coke product of any one of embodiments 1 to 11, wherein:

the coke product is produced from a coal blend comprising ash including $Al_2O_3$ and $SiO_2$; and a combined mass fraction of the $Al_2O_3$ and $SiO_2$ of the ash is no more than 65%.

13. The coke product of any one of embodiments 1 to 12, wherein the AFT is approximately 1204° C.

14. The coke product of any one of embodiments 1 to 13, wherein:

the coke product is produced from a coal blend comprising ash including $Al_2O_3$ and $SiO_2$; and a combined mass fraction of the $Al_2O_3$ and the $SiO_2$ of the ash is between 65% and 80%.

15. The coke product of any one of embodiments 1 to 14, wherein the AFT is between 1204° C. and 1260° C.

16. The coke product of any one of embodiments 1 to 15, wherein:

the coke product is made from a coal blend comprising ash including CaO; and a CaO mass fraction of the ash is at least 2.0%.

17. The coke product of any one of embodiments 1 to 16, wherein the coke product has a coke reactivity index (CRI) of is at least 25.0%.

18. The coke product of any one of embodiments 1 to 17, wherein the coke product has a Coke Strength After Reaction (CSR) that is no more than 40.0%.

19. The coke product of any one of embodiments 1 to 18, wherein the coke product has a 2-inch drop shatter of at least 90%.

20. The coke product of any one of embodiments 1 to 19, wherein the coke product has a 4-inch drop shatter of at least 80%.

21. The coke product of any one of embodiments 1 to 20, wherein a mass fraction of the ash of the coke product is at least 8.0%.

22. The coke product of any one of embodiments 1 to 21, wherein a volatile matter mass fraction of the coke product is no more than 1.0%.

23. The coke product of any one of embodiments 1 to 22, wherein a fixed carbon content of the coke product is at least 94.5%.

24. The coke product of any one of embodiments 1 to 23, wherein a fixed carbon content of the coke product is at least 85.0%.

25. The coke product of any one of embodiments 1 to 24, wherein the coke product comprises at least $Na^{+1}$, $Fe^{2+}$, or $F^{3+}$.

What is claimed is:

1. A coke product, comprising:

a Coke Reactivity Index (CRI) of at least 30%; and an ash fusion temperature (AFT) no more than 1316° C.

2. The coke product of claim 1, wherein the coke product has an initial deformation temperature between 1149° C. and 1316° C.

3. The coke product of claim 1, wherein the coke product has a softening temperature between 1177° C. and 1371° C.

4. The coke product of claim 1, wherein the coke product has a hemispherical temperature between 1204° C. and 1371° C.

5. The coke product of claim 1, wherein the coke product has a fluid temperature between and 1232° C. and 1427° C.

6. The coke product of claim 1, wherein the AFT is between 1204° C. and 1260° C.

7. The coke product of claim 1, wherein a fixed carbon content of the coke product is at least 85.0%.

8. A coke product, comprising:

ash having a composition that satisfies the following equation:

$$\text{Ash Fusion Temperature (AFT)}=19\times(Al_2O_3_mass_fraction)+15\times(SiO_2_mass_fraction+TiO_2_mass_fraction)+10\times(CaO_mass_fraction+MgO_mass_fraction)+6\times(Fe_2O_3_mass_fraction+Na_2O_mass_fraction+K_2O_mass_fraction),$$

wherein:

the AFT is a value between 982° C. and 1426° C.;

the $SiO_2$_mass_fraction is an $SiO_2$_mass_fraction of the ash;

the $Al_2O_3$_mass_fraction is an $Al_2O_3$_mass_fraction of the ash;

the $Fe2O_3$_mass_fraction is an $Fe_2O_3$_mass_fraction of the ash;

the CaO_mass_fraction is a CaO_mass_fraction of the ash;

the MgO_mass_fraction is an MgO_mass_fraction of the ash; and the $K_2O$_mass_fraction is an $K_2O$_mass_fraction of the ash.

9. The coke product of claim 8, wherein a mass fraction of the ash of the coke product is no more than 10.0%.

10. The coke product of claim 8, wherein a mass fraction of the ash of the coke product is at least 8.0%.

11. The coke product of claim 8, wherein a volatile matter mass fraction of the coke product is no more than 1.0%.

12. The coke product of claim 8, wherein a mass fraction of sulfur or sulfur oxide of the coke product is no more than 1.0%.

13. The coke product of claim 8, wherein:

the coke product is produced from a coal blend comprising ash including $Al_2O_3$ and $SiO_2$; and a combined mass fraction of the $Al_2O_3$ and $SiO_2$ of the ash is no more than 65%.

14. The coke product of claim 8, wherein:

the coke product is produced from a coal blend comprising ash including $Al_2O_3$ and $SiO_2$; and a combined mass fraction of the $Al_2O_3$ and the $SiO_2$ of the ash is between 65% and 80%.

15. The coke product of claim 8, wherein the AFT is approximately 1204° C.

16. The coke product of claim 8, wherein the AFT is between 1204° C. and 1260° C.

17. The coke product of claim 8, wherein:

the coke product is made from a coal blend comprising ash including CaO; and a mass fraction of the CaO of the ash is at least 2.0%.

18. The coke product of claim 8, wherein the coke product has a coke reactivity index (CRI) of at least 25.0%.

19. The coke product of claim 8, wherein the coke product has a Coke Strength After Reaction (CSR) that is no more than 40.0%.

20. The coke product of claim 8, wherein the coke product has a 2-inch drop shatter of at least 90%.

21. The coke product of claim 8, wherein the coke product has a 4-inch drop shatter of at least 80%.

22. The coke product of claim 8, wherein a fixed carbon content of the coke product is at least 85.0%.

23. The coke product of claim 8, wherein the AFT is approximately equal to at least one of 1260° C., 1288° C., 1316° C., 1343° C., 1371° C., 1399° C., or 1427° C.

24. A coke product, comprising:

ash having a composition that satisfies the following equation:

$$\text{Ash Fusion Temperature (AFT)}=19\times(Al_2O_3_mass_fraction)+15\times(SiO_2_mass_fraction+TiO_2_mass_fraction)+10\times(CaO_mass_fraction+MgO_mass_fraction)+6\times(Fe_2O_3_mass_fraction+Na_2O_mass_fraction),$$

wherein:

the AFT is a value between 982° C. and 1204° C.;

the $SiO_2$ mass fraction is an $SiO_2$ mass fraction of the ash;

the $Al_2O_3$ mass fraction is an $Al_2O_3$ mass fraction of the ash;

the $Fe_2O_3$ mass fraction is an $Fe_2O_3$ mass fraction of the ash;

the CaO_mass_fraction is a CaO_mass_fraction of the ash; and the MgO_mass_fraction is an MgO_mass_fraction of the ash.

25. A coke product, comprising:

ash having a composition that satisfies the following equation:

$$\text{Ash Fusion Temperature (AFT)}=401.5+26.3\times SiO_2_mass_fraction+40.7\times Al_2O_3_mass_fraction)-11.0\times Fe_2O_3_Mass_Fraction-7.9\times CaO_mass_fraction-112\times MgO_mass_fraction),$$

wherein:

the AFT is a value between 1204° C. and 1426° C.;

the $SiO_2$ mass fraction is an $SiO_2$ mass fraction of the ash;

the $Al_2O_3$ mass fraction is an $Al_2O_3$ mass fraction of the ash;

the $Fe_2O_3$ mass fraction is an $Fe_2O_3$ mass fraction of the ash;

the CaO_mass_fraction is a CaO_mass_fraction of the ash; and the MgO_mass_fraction is an MgO_mass_fraction of the ash.

* * * * *